US007163032B2

(12) United States Patent
Itabashi

(10) Patent No.: US 7,163,032 B2
(45) Date of Patent: Jan. 16, 2007

(54) DEVELOPER FILLING METHOD

(75) Inventor: Nao Itabashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 45 days.

(21) Appl. No.: 10/610,876

(22) Filed: Jul. 2, 2003

(65) Prior Publication Data

US 2004/0134560 A1 Jul. 15, 2004

(30) Foreign Application Priority Data

Jul. 2, 2002 (JP) ..... P2002-193908
Jul. 26, 2002 (JP) ..... P2002-218669
Sep. 27, 2002 (JP) ..... P2002-284277

(51) Int. Cl.
*B65B 1/20* (2006.01)

(52) U.S. Cl. ..... 141/12; 141/71; 141/286; 141/366; 399/258

(58) Field of Classification Search ..... 141/2, 141/12, 18, 69–74, 285, 286, 291, 292, 319, 141/346, 363, 366; 347/85, 86; 222/99, 222/100; 399/99–101, 258, 359
See application file for complete search history.

(56) References Cited

U.S. PATENT DOCUMENTS 5,144,382 A 9/1992 Funayama et al.
5,215,845 A 6/1993 Yusa et al.
5,287,150 A 2/1994 Kinoshita et al.
5,426,492 A * 6/1995 Diehl ..... 399/262
5,701,563 A 12/1997 Fukuda et al.
5,719,610 A * 2/1998 Scheffelin ..... 347/86
5,745,137 A * 4/1998 Scheffelin et al. ..... 347/85
5,887,227 A 3/1999 Kawai et al.
5,960,246 A * 9/1999 Kasahara et al. ..... 399/359
6,056,025 A * 5/2000 Wegman ..... 141/67
6,201,941 B1 3/2001 Kasahara et al.
6,331,053 B1 * 12/2001 Seccombe et al. ..... 347/85
6,337,956 B1 1/2002 Sato et al.
6,628,913 B1 * 9/2003 Matsumoto et al. ..... 399/258
6,871,033 B1 3/2005 Sato et al.

FOREIGN PATENT DOCUMENTS

JP 55-55914 4/1980
JP A 1-222277 9/1989
JP A-1-222277 9/1989
JP A-3-87866 4/1991
JP U-3-35002 4/1991
JP A-3-144471 6/1991
JP A 3-176308 7/1991
JP 3-210582 9/1991

(Continued)

*Primary Examiner*—Timothy L. Maust
(74) *Attorney, Agent, or Firm*—Oliff & Berridge, PLC

(57) ABSTRACT

The developer cartridge 24 is mounted in the holder 101 of the toner filling device 100 with the toner injecting through-hole 70 of the developer cartridge 24 on top. At this time, the axis of the developer roller 31 is vertical. The slide nozzle 110 is inserted into the toner injecting through-hole 70, such that the nozzle tip is positioned near the bottom of the toner accommodating chamber 34, and the toner expulsion device 120 injects toner into the developer cartridge 24. The toner is introduced with pressure, while the nozzle tip is gradually raised to match the amount of toner introduced.

38 Claims, 21 Drawing Sheets

FOREIGN PATENT DOCUMENTS

| | | |
|---|---|---|
| JP | 4-162049 | 6/1992 |
| JP | 4-351397 | 12/1992 |
| JP | A-5-46022 | 2/1993 |
| JP | 5-88541 | 4/1993 |
| JP | U-5-29060 | 4/1993 |
| JP | U-5-43164 | 6/1993 |
| JP | A 5-232810 | 9/1993 |
| JP | A-6-11958 | 1/1994 |
| JP | A 6-110304 | 4/1994 |
| JP | A 8-72821 | 3/1996 |
| JP | A-8-220883 | 8/1996 |
| JP | 8-305152 | 11/1996 |
| JP | 9-311553 | 12/1997 |
| JP | 11-184228 | 7/1999 |
| JP | A-2000-47466 | 2/2000 |
| JP | A-2000-066501 | 3/2000 |
| JP | A 2000-81778 | 3/2000 |
| JP | A-2000-258984 | 9/2000 |
| JP | A-2000-267411 | 9/2000 |
| JP | A 2001-34008 | 2/2001 |
| JP | 2001-278342 | 10/2001 |

* cited by examiner

DEVELOPER FILLING METHOD

BACKGROUND OF THE INVENTION

1. Field of the Invention

The present invention relates to a developer filling method for supplying developer to a developer cartridge used in such image forming devices as a printer, a photocopy machine, a facsimile device, or a multifunction device providing a combination of these functions; a developer cartridge; and a developer accommodating vessel.

2. Description of Related Art

Image forming device well known in the art including laser printers, photocopiers, facsimile devices, multifunction devices, and the like employ detachable developer cartridges for accommodating developer. These developer cartridges include a toner accommodating chamber for accommodating developer integrally formed with a developer roller for supplying the developer to a photosensitive drum in the image forming device. When the developer cartridge is mounted in the image forming device, a driving force from the image forming device is transferred to a developing roller to rotate the same, while developer is electrostatically attracted to the surface of the developing roller to form a thin layer thereon. This thin layer of developer is supplied to the photosensitive drum.

Powders, such as ground toner and polymer toner, are used as the developer. The particle size in the toner is approximately several to several tens of μm. When filling the developer cartridge with developer, the developer is dropped by gravity force from a hopper in a developer filling device into the developer cartridge. The operation needs to be done carefully so that the developer does not leak through a gap between the developer roller and a casing of the developer cartridge.

However when employing the method described above to fill the developer cartridge with developer, it is not possible to fill the developer cartridge with developer at a density greater than an apparent loose density, that is, the density of the developer compressed by its own weight. Hence, the volume of the developer cartridge must be greater than the volume of developer being introduced. This problem has been a detriment to attempts to reduce the size of the developer cartridge as well as the size of the image forming device.

On the other hand, one method for filling a vessel with toner is disclosed in Japanese patent application publication No. HEI-5-232810. This vessel includes an upper vessel cylinder having an open bottom end and a toner injection inlet formed in a suitable location, a lower vessel cylinder having an open top end, and a contracting cylinder for integrally coupling the lower edge on the open bottom end of the upper vessel cylinder with the upper edge on the open top end of the lower vessel cylinder in a watertight and airtight construction. The toner vessel includes at least one air escape through-hole at an appropriate location to allow air to escape when the contracting cylinder is contracted to compress the overall toner vessel. After filling the toner vessel with toner, the toner vessel can be compressed by moving the upper vessel cylinder toward the lower vessel cylinder to contract the contracting cylinder. In this way, the toner vessel can be made smaller, even when air enters the cylinder during the toner filling operation.

However, when filling the vessel with toner, the toner mixes with air when poured into the vessel into the vessel. Therefore, the vessel must be configured sufficiently long in the direction that the toner is introduced.

However, in the toner filling method disclosed in Japanese patent application publication No. HEI-5-232810, the direction for introducing toner is the same as the direction in which the toner vessel is compressed. In other words, the vessel is shortened in the filling direction. Therefore, by securing sufficient length of the vessel in the direction in which toner is introduced, the distance in which the vessel is compressed becomes longer, leading to various problems including a need to increase the length of the contracting cylinder, a need to increase the compressing distance, and an increased complexity in the filling operation.

SUMMARY OF THE INVENTION

In view of the foregoing, it is an object of the present invention to provide a developer filling method for filling a developer cartridge with developer, allowing the casing of the developer cartridge to be reduced in size, as well as a developer cartridge, a developer accommodating vessel, and an image forming device employed for the developer filling method.

It is another object of the present invention to provide a developer filling method capable of filling efficiently a developer cartridge with developer and capable of increasing the efficiency of the filling operation, as well as a developer accommodating vessel, a developer cartridge, a processing device, and an image forming device employed for the developer filling method.

In order to attain the above and other objects, the present invention provides a developer filling method for filling an accommodating chamber in a casing with developer. The developer filling method includes preparing a casing defining an accommodating chamber, the casing being formed with a developer supply through-hole for introducing developer into the accommodating chamber and an opening for supplying the developer out of the accommodating chamber, and filling the accommodating chamber with the developer at a density equal to or higher than an apparent loose density.

The present invention also provides a developer filling method for filling an accommodating chamber in a casing with developer. The developer filling method includes inserting a tip of a developer supplying nozzle of a developer filling device into a developer supply through-hole which is formed in a top of a casing and which is communicated with an accommodating chamber in the casing, and pressurizing the developer in the developer filling device and filling the accommodating chamber with the developer by forcing the developer out of the developer supplying nozzle with pressure through the tip of the developer supplying nozzle inserted into the developer supply through-hole.

The present invention also provides a developer filling method for filling an accommodating chamber in a developer cartridge with developer. The developer cartridge includes a casing defining the accommodating chamber for accommodating developer, a developer carrying member for supplying developer accommodated in the accommodating chamber to an electrostatic latent image bearing member on which an electrostatic latent image is formed, the casing having an end wall on one end thereof along an axial direction of the developer carrying member, an opposite end wall on the other end of the axial direction, and a lengthwise wall extending along the axial direction, a developer supply through-hole formed in the end wall of the casing for introducing developer into the accommodating chamber, and an opening formed in the lengthwise wall of the casing for exposing the developer carrying member to an area outside the casing. The method includes arranging the developer cartridge such that the axial direction of the developer carrying member is substantially aligned with the direction of gravitational force, with the opening being positioned to face horizontally and the developer supply through-hole being positioned to face upward, inserting a tip of a developer supplying nozzle of a developer filling device into the developer supply through-hole of the developer cartridge, and pressurizing the developer in the developer filling device and filling the accommodating chamber with the developer by forcing the developer out with pressure through the tip of the developer supplying nozzle inserted into the developer supply through-hole.

The present invention also provides a developer filling method for filling a developer cartridge with developer. The developer cartridge includes a casing defining an accommodating chamber for accommodating developer, and a developer carrying member for supplying developer accommodated in the accommodating chamber to an electrostatic latent image bearing member on which an electrostatic latent image is formed, the casing having an end wall on one end thereof along an axial direction of the developer carrying member, an opposite end wall on the other end of the axial direction, and a lengthwise wall extending along the axial direction. The method includes filling the accommodating chamber with developer, and applying vibrations to the developer cartridge.

The present invention also provides a developer filling method. The developer filling method includes filling a casing with developer, and compressing the casing in a direction different from a direction in which developer is introduced into the casing.

The present invention also provides a developer accommodating vessel. The developer accommodating vessel includes a casing defining an accommodating chamber, and developer accommodated in the casing, the accommodating chamber being filled with the developer at a density equal to or higher than an apparent loose density.

The present invention also provides a developer accommodating vessel. The developer accommodating vessel includes a casing defining an accommodating chamber, developer accommodated in the casing, a developer supply through-hole formed with the casing for filling the accommodating chamber with the developer, and an opening formed with the casing for supplying the developer out of the accommodating chamber, wherein the developer is introduced into the accommodating chamber such that the opening is positioned to face horizontally and the developer supply through-hole is positioned to fate upward, and pressurized developer is introduced into the accommodating chamber via a developer supplying nozzle of a developer filling device inserted into the developer supply through-hole.

The present invention also provides a developer accommodating vessel. The developer accommodating vessel includes a casing defining an accommodating chamber, and developer accommodated in the casing, vibrations being applied to the casing when or after the developer is introduced into the accommodating chamber.

The present invention also provides a developer cartridge. The developer cartridge includes a casing defining an accommodating chamber for accommodating developer, a developer carrying member for supplying developer accommodated in the accommodating chamber to an electrostatic latent image bearing member on which an electrostatic latent image is formed, the casing having an end wall on one end thereof along an axial direction of the developer carrying member, an opposite end wall on the other end of the axial direction, and a lengthwise wall extending along the axial direction, a developer supply through-hole formed in the end wall of the casing for introducing developer into the accommodating chamber, and an opening formed in the lengthwise wall of the casing for exposing the developer carrying member to an area outside the casing, wherein the casing is disposed such that the axial direction of the developer carrying member is substantially aligned with the direction of gravitational force, with the opening positioned on the side thereof and the developer supply through-hole on the top, and pressurized developer is introduced into the accommodating chamber via a developer supplying nozzle of a developer filling device inserted into the developer supply through-hole.

The present invention also provides a developer cartridge. The developer cartridge includes a casing defining an accommodating chamber for accommodating developer, a developer carrying member for supplying developer to an electrostatic latent image bearing member on which an electrostatic latent image is formed, a developer supply through-hole formed in the casing for introducing developer into the accommodating chamber so that the accommodating chamber is filled with the developer through the developer supply through-hole at a density higher than an apparent loose density, and an opening formed in the casing along an axial direction of the developer carrying member, the opening exposing the developer carrying member to an area outside the casing.

The present invention also provides an image forming device. The image forming device includes a developer cartridge including a casing defining an accommodating chamber for accommodating developer, a developer carrying member for supplying developer accommodated in the accommodating chamber to an electrostatic latent image bearing member on which an electrostatic latent image is formed, the casing having an end wall on one end thereof along an axial direction of the developer carrying member, an opposite end wall on the other end of the axial direction, and a lengthwise wall extending along the axial direction, a developer supply through-hole formed in the end wall of the casing for introducing developer into the accommodating chamber, and an opening formed in the lengthwise wall of the casing for exposing the developer carrying member to an area outside the casing, wherein the casing is disposed such that the axial direction of the developer carrying member is substantially aligned with the direction of gravitational force, with the opening positioned on the side thereof and the developer supply through-hole on the top, and pressurized developer is introduced into the accommodating chamber via a developer supplying nozzle of a developer filling device inserted into the developer supply through-hole, and the electrostatic latent image bearing member for forming an electrostatic latent image thereon.

The present invention also provides a developer cartridge. The developer cartridge includes a developer carrying member supplying developer to an electrostatic latent image bearing member on which an electrostatic latent image is formed, and a casing defining an accommodating chamber that is filled with developer and that has been applied with vibrations.

The present invention also provides a developer cartridge. The developer cartridge includes a developer carrying member supplying developer to an electrostatic latent image bearing member on which an electrostatic latent image is formed, and a casing defining an accommodating chamber that is filled with developer at a density higher than an apparent loose density.

The present invention also provides an image forming device. The image forming device includes an electrostatic latent image bearing member forming an electrostatic latent image thereon, and a developer cartridge including a developer carrying member supplying developer to the electrostatic latent image bearing member, and a casing defining an accommodating chamber that is filled with developer and that has been applied with vibrations.

The present invention also provides a developer accommodating vessel. The developer accommodating vessel includes a casing accommodating developer therein, and a developer supply through-hole formed in the casing for filling the casing with developers the casing being capable of being compressed in a direction different from a filling direction in which developer is introduced through the developer supply through-hole.

The present invention also provides a developer accommodating vessel for accommodating developer. The developer accommodating vessel includes a first casing section having a first sponge member and defining an accommodating chamber accommodating developer, and a second casing section having a second sponge member, the second casing section moving in contact with the first casing section with opposing surfaces of the first sponge member and the second sponge member sliding against each other.

The present invention also provides a developer cartridge. The developer cartridge includes a developer accommodating vessel including a casing accommodating developer therein, and a developer supply through-hole formed in the casing for filling the casing with developer, the casing being capable of being compressed in a direction different from a filling direction in which developer is introduced through the developer supply through-hole, and a developer carrying member for receiving the developer supplied from the casing.

The present invention also provides a processing device. The processing device includes a developer cartridge including a developer accommodating vessel having a casing accommodating developer therein, and a developer supply through-hole formed in the casing for filling the casing with developer, the casing being capable of being compressed in a direction different from a filling direction in which developer is introduced through the developer supply through-hole, and a developer carrying member for receiving the developer supplied from the casing, and an electrostatic latent image bearing member for forming an electrostatic latent image thereon and for receiving the developer from the developer carrying member.

The present invention also provides an image forming device. The image forming device includes a developer cartridge including a developer accommodating vessel having a casing accommodating developer therein, and a developer supply through-hole formed in the casing for filling the casing with developer, the casing being capable of being compressed in a direction different from a filling direction in which developer is introduced through the developer supply through-hole, and a developer carrying member for receiving the developer supplied from the casing, and an electrostatic latent image bearing member for forming an electrostatic latent image thereon and for receiving the developer from the developer carrying member.

The present invention also provides an image forming device. The image forming device includes a processing device including a developer cartridge having a developer accommodating vessel having a casing accommodating developer therein, and a developer supply through-hole formed in the casing for filling the casing with developer, the casing being capable of being compressed in a direction different from a filling direction in which developer is introduced through the developer supply through-hole, and a developer carrying member for receiving the developer supplied from the casing, and an electrostatic latent image bearing member for forming an electrostatic latent image thereon and for receiving the developer from the developer carrying member.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

A developer filling method, a developer cartridge, and an image forming device employing the developer cartridge according to a first embodiment will be described while referring to the accompanying drawings.

First, the constructions of a developer cartridge 24 and a laser printer 1 will be described with reference to FIGS. 1 through 5.

Figure 1:
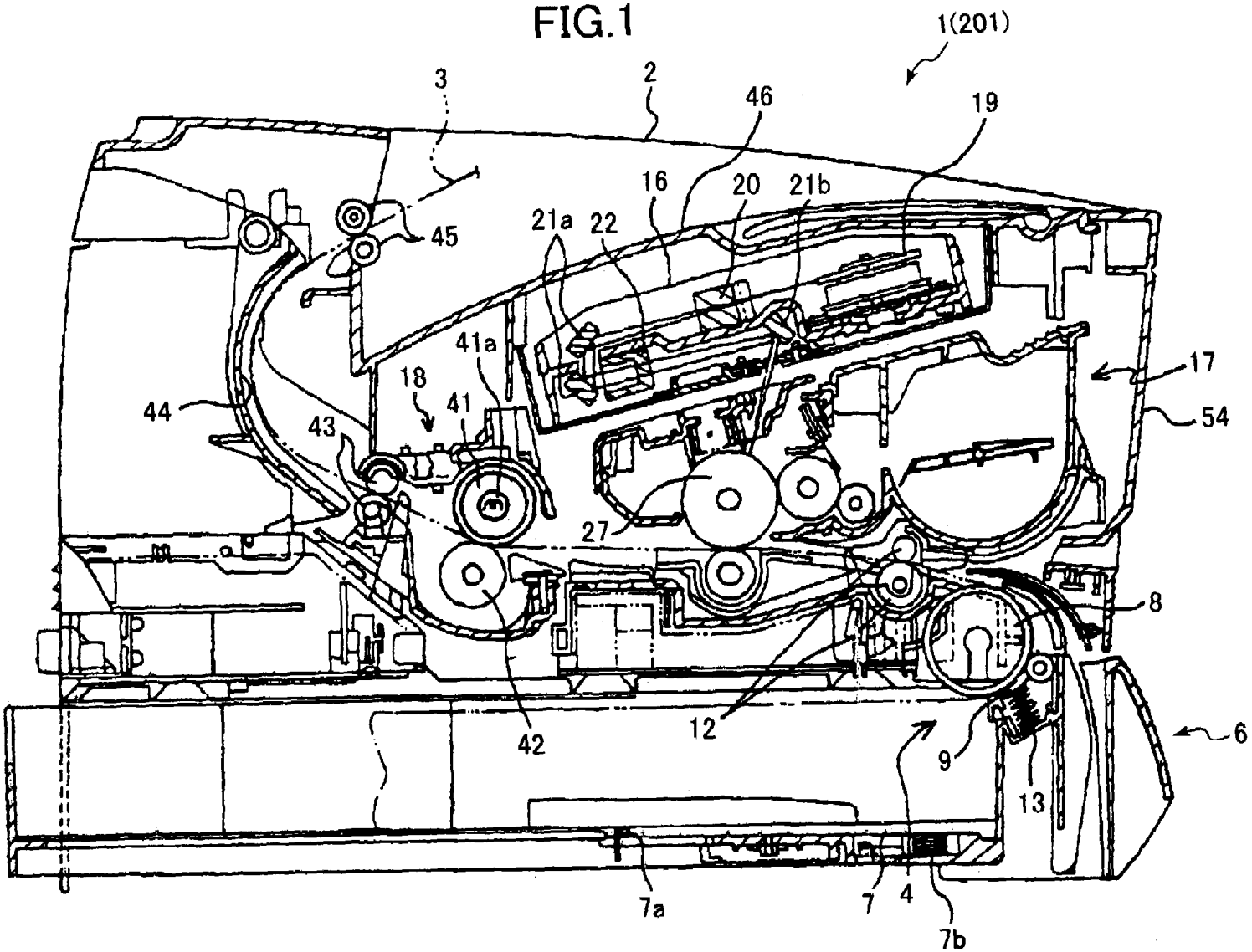
FIG. 1 is a center cross-sectional view showing a laser printer according to first and second embodiments of the present invention.

As shown in the cross-sectional view of FIG. 1, the laser printer 1 includes a main case 2 and, within the main case 2, a feeder unit 4 for feeding sheets of paper 3 as the recording medium, a scanning unit 16 including an image forming unit for printing images on the supplied paper 3, a processing cartridge 17, a fixing unit 18, and the like. The right side in the drawing denotes the front surface of the laser printer 1.

A discharge tray 46 is formed as a depression in the top of the main case 2 from the top center of the main case 2 to the front side, the slope of the depression lessening toward the front side of the main case 2 for maintaining printed paper 3 in a stacked state. A open space is formed in a section in the front surface of the main case 2 near the top for inserting the processing cartridge 17. A space for inserting or removing the processing cartridge 17 can be created by rotating a cover 54 provided on the front side (the right side in the FIG. 1) of the main case 2 downward.

A paper discharge path 44 is provided in the back of the main case 2 (the left side in the drawing), forming an arc from top to bottom along the back surface of the main case 2. The paper discharge path 44 serves to guide the paper 3 discharged from the fixing unit 18 that is disposed in the lower back section of the main case 2 to the discharge tray 46 provided on the top of the main case 2. Discharge rollers 45 are provided along the paper discharge path 44 to convey the paper 3.

The feeder unit 4 includes a feed roller 8 provided in the bottom section of the main case 2; a feed cassette 6 detachably mounted in the front surface of the laser printer 1 and capable of being mounted or removed in the front-to-back direction; a paper pressing plate 7 disposed in the feed cassette 6 for retaining the stacked paper 3 and pressing the paper 3 into contact with the feed roller 8; a separating pad 9 provided in the top of the feed cassette 6 on one end, which applies pressure toward the feed roller 8 and works in cooperation with the feed roller 8 during a paper feed operation to separate the paper 3 one sheet at a time; and register rollers 12 disposed downstream from the feed roller 8 in the conveying direction of the paper 3 for adjusting the timing in which the paper 3 is fed for printing.

Sheets of the paper 3 can be stacked on the paper pressing plate 7. A support shaft 7*a* provided on the end of the paper pressing plate 7 farthest from the feed roller 8 maintains the paper pressing plate 7 on the bottom surface of the feed cassette 6, enabling the end of the paper pressing plate 7 nearest the feed roller 8 to move up and down while rotating around the support shaft 7*a*. A spring 7*b* disposed on the underside of the paper pressing plate 7 urges the paper pressing plate 7 toward the feed roller 8. As more sheets of paper 3 are stacked on the paper pressing plate 7, the paper pressing plate 7 resists the urging force of the spring 7*b* and pivots downward about the support shaft 7*a*. The feed roller 8 and separating pad 9 are disposed in confrontation with each other. A spring 13 provided on the underside of the separating pad 9 presses the separating pad 9 toward the feed roller 8.

The scanning unit 16 of the image forming unit is disposed directly beneath the discharge tray 46 in the main case 2. The scanning unit 16 includes a laser light emitting unit (not shown in the drawing) for emitting laser light, a polygon mirror 19 that is driven to rotate in order to scan the laser light emitted by the laser light emitting unit in a main scanning direction, an fθ lens 20 for fixing the scanning speed of the laser light scanned by the polygon mirror 19, reflecting mirrors 21*a* and 21*b* for reflecting the scanned laser light, a relay lens 22 for adjusting the focal point of laser light reflected by the reflecting mirrors 21*a* in order to form an image on a photosensitive drum 27 via the reflecting mirror 21*b*, and the like. Hence, the surface of the photosensitive drum 27 in the processing cartridge 17 is exposed to laser light scanned by the scanning unit 16 based on print data. The laser light is emitted from the laser light emitting unit and passes through or is reflected by the polygon mirror 19, fθ lens 20, reflecting mirrors 21*a*, relay lens 22, and reflecting mirror 21*b* in the order given.

The fixing unit 18 is disposed to the side of and downstream of the processing cartridge 17. The fixing unit 18 includes a heat roller 41, a pressure roller 42 applying pressure to the heat roller 41, and a pair of conveying rollers 43 disposed downstream of the heat roller 41 and pressure roller 42. The heat roller 41 includes a halogen lamp 41*a* for heating the interior of the cylindrical roller. The toner that is transferred to the surface of the paper 3 in the processing cartridge 17 is fixed to the paper 3 by heat, as the paper 3 passes between the heat roller 41 and pressure roller 42. Subsequently, the conveying rollers 43 convey the paper 3 along the paper discharge path 44.

Figure 2:
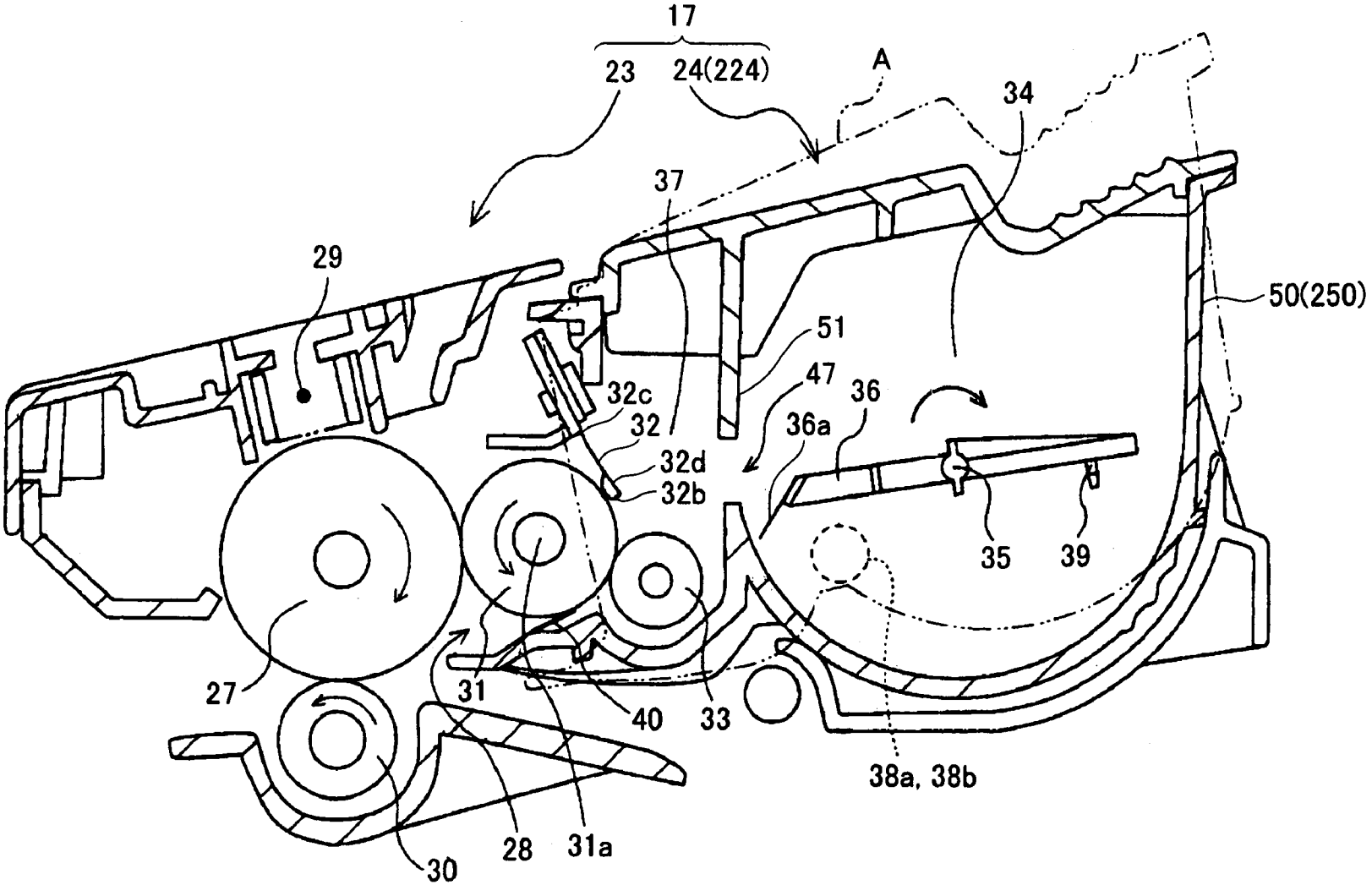
FIG. 2 is a side cross-sectional view showing a processing cartridge according to the first and second embodiments.

As shown in FIG. 2, the processing cartridge 17 in the image forming unit includes a drum cartridge 23 and the developer cartridge 24 detachably mounted on the drum cartridge 23. The drum cartridge 23 includes the photosensitive drum 27, a Scorotron type charging device 29, a transfer roller 30, and the like. The developer cartridge 24 includes a casing 50 and an inside wall 51 defining a developing chamber 37 and a toner accommodating chamber 34. The developer cartridge 24 further includes a developer roller 31, a supply roller 33, a thickness regulating blade 32, a sealing member 40, and the like, provided in the developing chamber 37.

The photosensitive drum 27 of the drum cartridge 23 is disposed to the side of the developer roller 31 with the rotating shaft of the photosensitive drum 27 parallel to the rotating shaft of the developer roller 31. The photosensitive drum 27 is capable of rotating in the direction indicated by the arrow (clockwise in the drawing) while in contact with the developer roller 31. The photosensitive drum 27 includes a conductive base on which are layered a charge generating layer in which a positively-charged organic light conductor, such as an azo pigment or a phthalocynanine pigment, as the charge generating material is dispersed in a binder resin; a charge transporting layer in which such compounds as hydrazones or arylamines are mixed in a polycarbonate or other resin; and the like. When the photosensitive drum 27 is exposed to laser light or the like, a charge is generated in the charge generating layer from the absorbed light. This charge is transported to the conductive base and the surface of the photosensitive drum 27 via the charge transporting layer, negating the potential on this surface that has been applied by the charging device 29. In this way, a potential differential can be achieved between areas that have been exposed to light and areas that have not. Electrostatic latent images are formed on the photosensitive drum 27 by exposing the surface of the photosensitive drum 27 to a laser light scanned according to print data.

The charging device 29 is disposed above the photosensitive drum 27 and separated a predetermined distance therefrom so as not to contact the photosensitive drum 27. The charging device 29 is a positive charging scorotron charger having a charging wire formed of tungsten or the like from which a corona discharge is generated. By switching on and off a charging bias circuit (not shown), the charging device 29 applies a uniform charge of positive polarity across the entire surface of the photosensitive drum 27.

When the developer cartridge 24 is mounted on the drum cartridge 23, the developer roller 31 is positioned downstream of the charging device 29 in the rotating direction of the photosensitive drum 27 (clockwise in the drawing) and is capable of rotating in the direction indicated by the arrow (counterclockwise in the drawing). The developer roller 31 includes a metal roller shaft covered by a roller formed of a conductive rubber material. A developer bias circuit (not shown) applies a developer bias to the developer roller 31.

The supply roller 33 is rotatably disposed on the side of the developer roller 31 opposite the side of the photosensitive drum 27 and contacts the developer roller 31 while applying pressure to the same. The supply roller 33 includes a metal roller shaft covered by a roller formed of a conductive foam material and is configured to tribocharge toner supplied to the developer roller 31.

The toner accommodating chamber 34 is positioned to the side of the supply roller 33 and is filled with developer to be supplied to the developer roller 31 via the supply roller 33. In the present embodiment, the developer is a positively charged nonmagnetic single-component toner. The developer is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1–C4) acrylate, or alkyl (C1–C4) meta acrylate. The polymerized toner is formed as particles substantially spherical in shape in order to have excellent fluidity. The toner is compounded with a coloring agent such as carbon black or wax, as well as an additive such as silica to improve fluidity. The diameter of the toner particles is about 6–10 μm.

An agitator 36 has a coarse mesh-like plate shape formed substantially rectangular. A film member 36*a* functioning to scrape the inner wall of the toner accommodating chamber 34 is provided on the end of the agitator 36. A rotating shaft 35 is formed along one lengthwise edge of the agitator 36, supporting the agitator 36 on both lengthwise ends of the toner accommodating chamber 34. The agitator 36 rotates in the direction of the arrow (clockwise in the drawing) to stir toner in the toner accommodating chamber 34.

The thickness regulating blade 32 is a blade formed of a thin metal leaf spring extending along the axial direction of the developer roller 31. One end of the thickness regulating blade 32 is fixed on the inner wall of the casing 50 near the developer roller 31, which is a fixed end 32*c*. The other end is a free end 32*d*, on which a pressing member 32*b* is provided along the axial direction of the developer roller 31. The pressing member 32*b* has a semicircular shaped cross-section and is formed of an insulating silicon rubber. The pressing member 32*b* is configured to pressingly contact the developer roller 31 by the elastic force of the blade member.

The sealing member 40 is provided to prevent toner from leaking out through gaps between the developer roller 31 and the inner wall of the casing 50. The sealing member 40 is a thin plastic film extending in the axial direction of the developer roller 31. One end of the sealing member 40 (fixed end) is fixed to the inner wall of the casing 50 on the opposite side of the developer roller 31 from the thickness regulating blade 32. The other end of the sealing member 40 (free end) elastically contacts the outer surface of the developer roller 31 at a position closer to the toner accommodating chamber 34 than the fixing position.

The transfer roller 30 is provided below the photosensitive drum 27 and downstream of the developer roller 31 in the rotating direction of the photosensitive drum 27. The transfer roller 30 is supported to be able to rotate in the direction of the arrow (counterclockwise in the drawing). The transfer roller 30 includes a metal roller shaft covered by a roller formed of an ion-conducting rubber material. During a transfer process, a transfer bias circuit (not shown) applies a transfer bias to the transfer roller 30. A transfer bias is a bias applied to the transfer roller 30 to generate a potential difference that causes toner electrostatically deposited on the surface of the photosensitive drum 27 to be electrically attracted toward the surface of the transfer roller 30.

In this laser printer 1, the transfer roller 30 transfers toner from the photosensitive drum 27 to the paper 3. Subsequently, the developer roller 31 recovers toner remaining on the surface of the photosensitive drum 27, employing what is known as a cleanerless developing system. The use of this type of cleanerless system to recover residual toner on the photosensitive drum 27 can aid in the simplification of the device construction and reduce costs by eliminating the need for a blade or other cleaning device and a reservoir for recovering waste toner.

When removing the developer cartridge 24 from the processing cartridge 17, first a stopper (not shown) fixing the drum cartridge 23 to the developer cartridge 24 is disengaged. Next, the developer cartridge 24 is rotated about a shaft 31*a* of the developer roller 31 in a direction that separates the developer roller 31 from the photosensitive drum 27, as indicated by a two-dot chain line A in FIG. 2.

The inside space of the developer cartridge 24 is separated by the inside wall 51, forming the toner accommodating chamber 34 and the developing chamber 37. As described above, a rectangular opening 28 is formed in the developer cartridge 24 along the axial direction of the developer roller 31, such that the developer roller 31 is exposed from the developing chamber 37 and contacts the photosensitive drum 27. The supply roller 33 is also provided in the developing chamber 37. A toner supply through-hole 47 having a width smaller than a diameter of the developer roller 31 is formed in the inside wall 51 between the developing chamber 37 and toner accommodating chamber 34 along the axial direction of the developer roller 31. Since the toner supply through-hole 47 regulates the amount of toner supplied from the toner accommodating chamber 34 to the developing chamber 37, the pressure of toner applied to the developing chamber 37 is alleviated.

Figure 3:
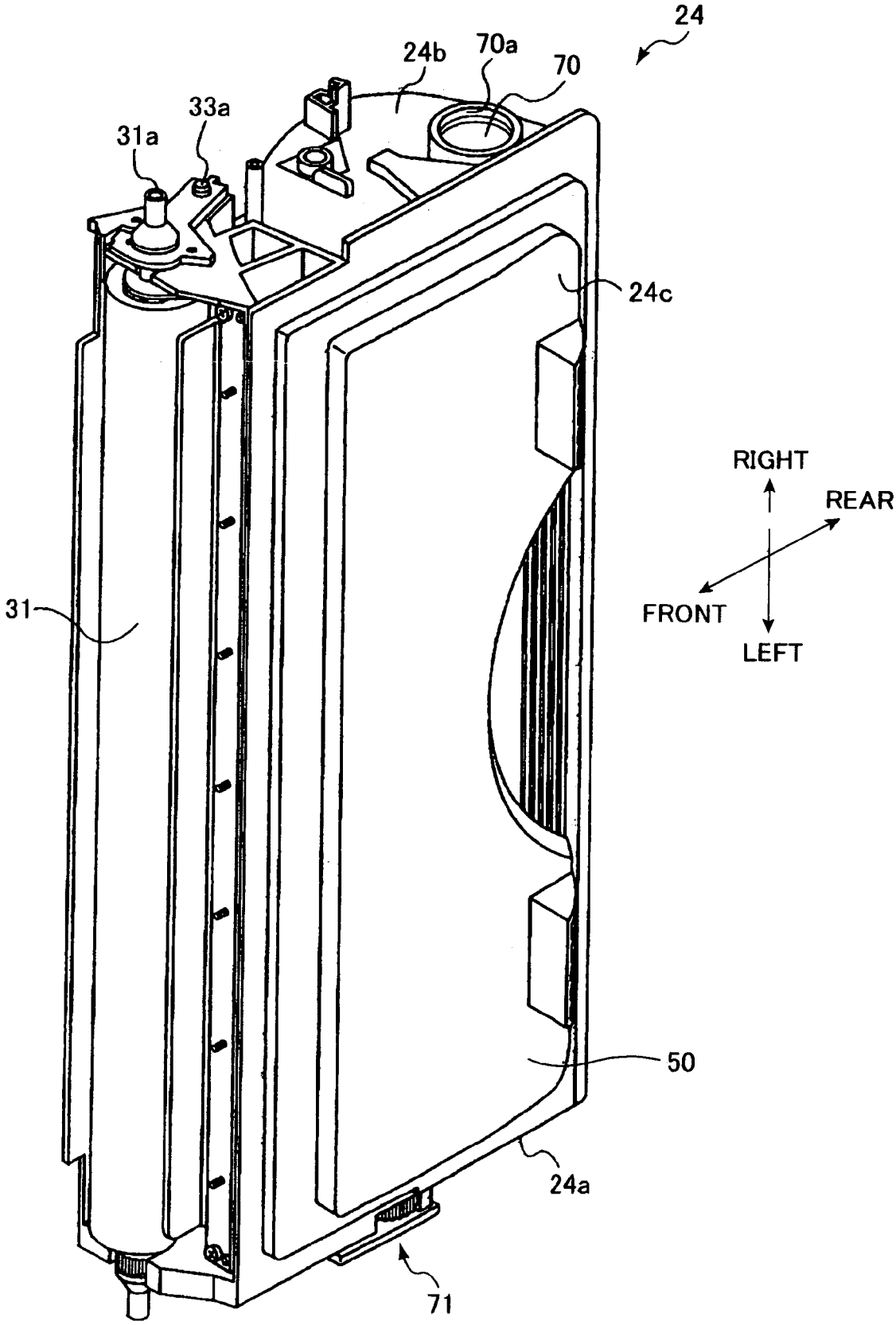
FIG. 3 is a perspective view showing a developer cartridge according to the first embodiment.
Figure 4:
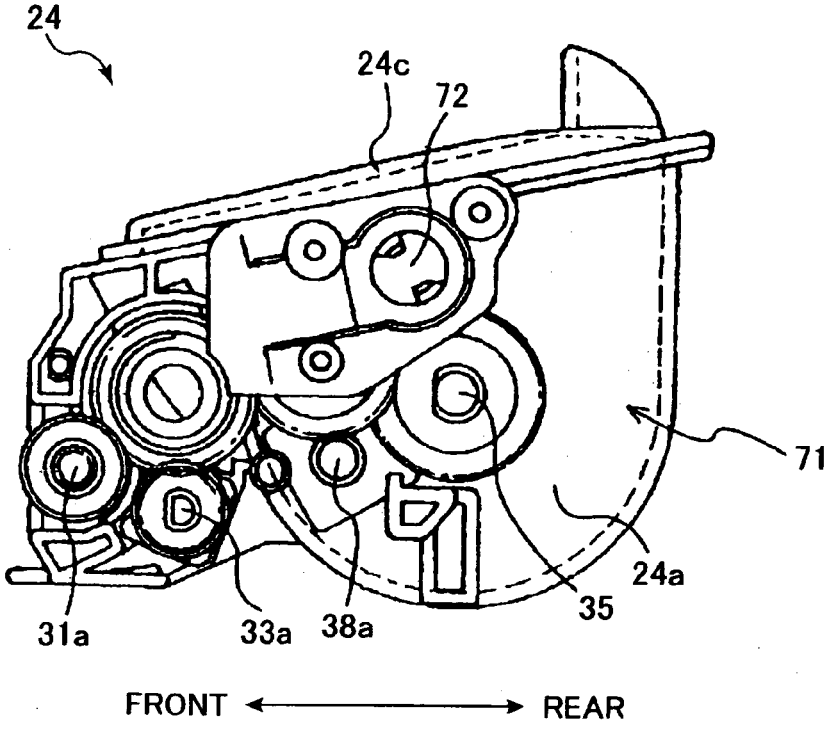
FIG. 4 is a left side view showing the developer cartridge according to the first embodiment.
Figure 5:
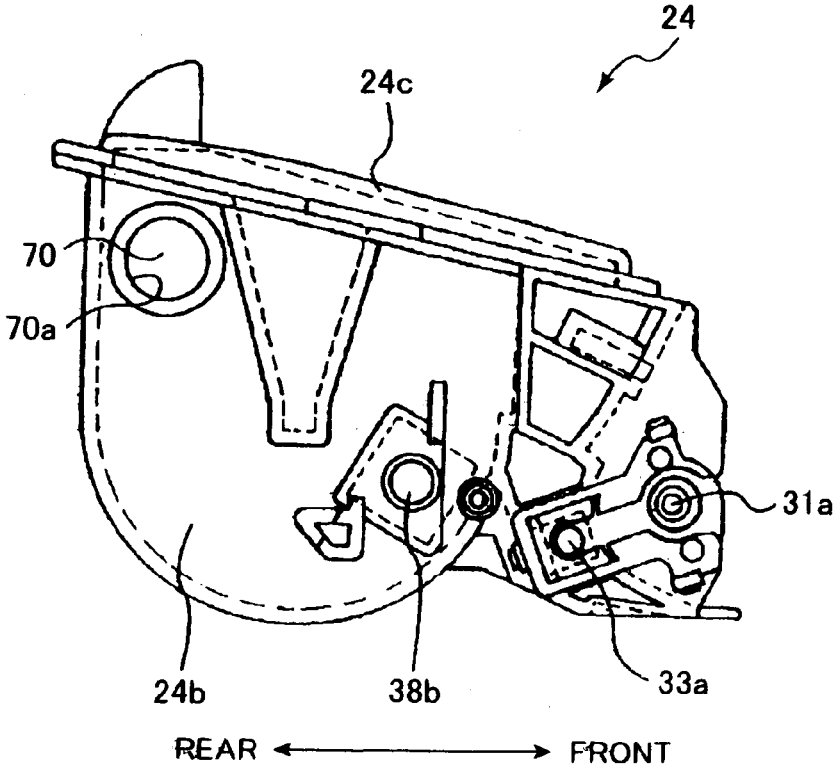
FIG. 5 is a right side view showing the developer cartridge according to the first embodiment.

Hereinafter, the front direction in which the processing cartridge 17 is mounted in the laser printer 1 is denoted as the front direction, as shown in FIG. 3. The rear, right and left directions are denoted in the same way. As shown in FIGS. 3 through 5, hearing through-holes for the shaft 31*a* of the developer roller 31, a shaft 33*a* of the supply roller 33, and the shaft 35 of the agitator 36 accommodated in the developer cartridge 24 penetrate through a left side surface 24*a* in the lengthwise direction of the developer cartridge 24 (the side surface on the left side). Gears rotating about the shaft 31*a*, shaft 33*a*, and rotating shaft 35 are disposed on and exposed from the left side surface 24*a* outside the casing of the developer cartridge 24. A gear train 71 is configured of these gears and linking gears that link adjacent gears. A gear provided in a drive input unit 72 is engaged with the gear train 71. When the processing cartridge 17 is mounted in the laser printer 1, a driving force generated by the laser printer 1 is transferred to the gear train 71 via the drive input unit 72, driving each of the developer roller 31, supply roller 33, and agitator 36 to rotate.

Windows 38*a* and 38*b* for detecting the amount of remaining toner are provided in the left side surface 24*a* and a right side surface 24*b* (the side surface on the right side) of the developer cartridge 24. The amount of remaining toner is detected by, for example, projecting an LED light through the window 38*a* into the developer cartridge 24 and determining whether a photosensor (not shown) can detect the LED light through the window 38*b* of the right side surface 24*h*. Accordingly, cleaners 39 (see FIG. 2) formed of urethane rubber or the like are provided one on either end of the rotating shaft 35 and positioned axisymmetrically to the agitator 36 in relation to the rotating shaft 35.

A toner injecting through-hole 70 in fluid communication with the toner accommodating chamber 34 is formed in the right side surface 24*b*. In the manufacturing process of the developer cartridge 24, the toner accommodating chamber 34 is filled with toner through the toner injecting through-hole 70 and subsequently a cap 70*a* formed of polypropylene or a similar material is used to seal the toner injecting through-hole 70. Further, as with the left side surface 24*a*, bearing through-holes penetrate the right side surface 24*b* for the shaft 31*a* of the developer roller 31 and the shaft 33*a* of the supply roller 33. However, a bearing through-hole for the rotating shaft 35 of the agitator 36 does not penetrate the right side surface 24*b*. Instead a depression is formed in the wall surface of the toner accommodating chamber 34, that is, the inner surface of the casing 50 for the right side surface 24*b*.

Next, the operations of the laser printer 1 during a printing process will be described with reference to FIGS. 1 and 2. The topmost sheet of the paper 3 stacked on the paper pressing plate 7 in the feed cassette 6 is pressed toward the feed roller 8 by the spring 7*b* from the bottom of the paper pressing plate 7. As printing begins based on print data received from a host computer (not shown), the frictional force of the rotating feed roller 8 conveys the paper 3 in between the feed roller 8 and the separating pad 9. The separated single sheet of paper 3 is conveyed to the register rollers 12.

In the scanning unit 16, in the meantime, laser light generated by the laser light emitting unit (not shown) is irradiated on the polygon mirror 19 based on laser drive signals generated by an engine controller (not shown). The polygon mirror 19 irradiates the fθ lens 20 by scanning the incident laser light in a main scanning direction (the direction orthogonal to the direction in which the paper 3 is conveyed). The fθ lens 20 converts the laser light scanned by the polygon mirror 19 at a constant angular velocity into a scanning motion of constant velocity. The direction of the laser light is changed by the reflecting mirrors 21*a* and converged by the relay lens 22. An image is formed on the surface of the photosensitive drum 27 via the reflecting mirror 21*b*.

The charging device 29 charges the photosensitive drum 27 to achieve a surface potential of about 1000 V, for example. Next, the photosensitive drum 27 rotating in the direction of the arrow (clockwise in FIG. 2) receives the irradiated laser light. The laser light is irradiated such that parts to be developed along the main scanning line of the paper 3 are irradiated while parts that are not to be developed are not irradiated. The surface potential at parts irradiated by laser light (bright areas) drops to about 100 V, for example. The laser light is irradiated also in a sub scanning direction (the direction in which the paper 3 is conveyed) as the photosensitive drum 27 rotates. The portions not irradiated by laser light (dark areas) and the bright areas form invisible electrical images, that is, electrostatic latent images on the surface of the photosensitive drum 27.

Toner accommodated in the toner accommodating chamber 34 is conveyed into the developing chamber 37 by the rotation of the agitator 36 and supplied onto the developer roller 31 by the rotation of the supply roller 33 within the developing chamber 37. At this time, the toner is positively thribocharged between the supply roller 33 and the developer roller 31. The toner carried on the developer roller 31 is adjusted to a uniform thin layer by the thickness regulating blade 32. A positive bias of about 300–400 V, for example, is applied to the developer roller 31. As the developer roller 31 rotates, the positively charged toner carried on the surface thereof comes into contact with the photosensitive drum 27 and is transferred to the electrostatic latent image formed on the surface thereof. That is, since the potential of the developer roller 31 is lower than the potential of a dark area (+1000 V) and higher than the potential at a bright area (+100 V), the toner is selectively transferred to bright areas having the lower potential. In this way, a developing process is performed to form a visible image with toner on the surface of the photosensitive drum 27 as a developer image.

The register rollers 12 adjust the paper 3 to a proper register, then feeds the paper 3 at a timing such that the leading edge of the visible image formed on the surface of the rotating photosensitive drum 27 matches the leading edge of the paper 3. A negative bias lower than the potential in the bright areas (+100 V), for example about −200 V, is applied to the transfer roller 30 as the paper 3 passes between the photosensitive drum 27 and the transfer roller 30, thereby transferring the visible image formed on the surface of the photosensitive drum 27 to the surface of the paper 3.

After the toner is transferred to the paper 3, the paper 3 is conveyed to the fixing unit 18. The fixing unit 18 applies heat of about 200 degrees Celsius with the heat roller 41 and pressure with the pressure roller 42 to the paper 3 carrying the toner image, thereby forming a permanent image by fusing the toner into the surface of the paper 3. The heat roller 41 and pressure roller 42 are grounded via diodes and configured such that the surface potential of the pressure roller 42 is lower than the surface potential of the heat roller 41. Accordingly, since positively charged toner carried on the heat roller 41 side of the paper 3 is electrically attracted to the pressure roller 42 through the paper 3, image distortions during the fixing process that are caused by toner being attracted to the heat roller 41 are prevented.

After the toner is fixed on the paper 3 through heat and pressure, the paper 3 is discharged from the fixing unit by the conveying rollers 43 and conveyed along the paper discharge path 44. The discharge rollers 45 discharges the paper 3 with printed surface facing downward onto the discharge tray 46. Similarly, the next sheet of paper 3 that is printed is stacked on the discharge tray 46 facing printed surface downward on top of the previously discharged paper 3. Accordingly, the user can obtain the sheets of paper 3 sorted in the order that they are printed.

Figure 6:
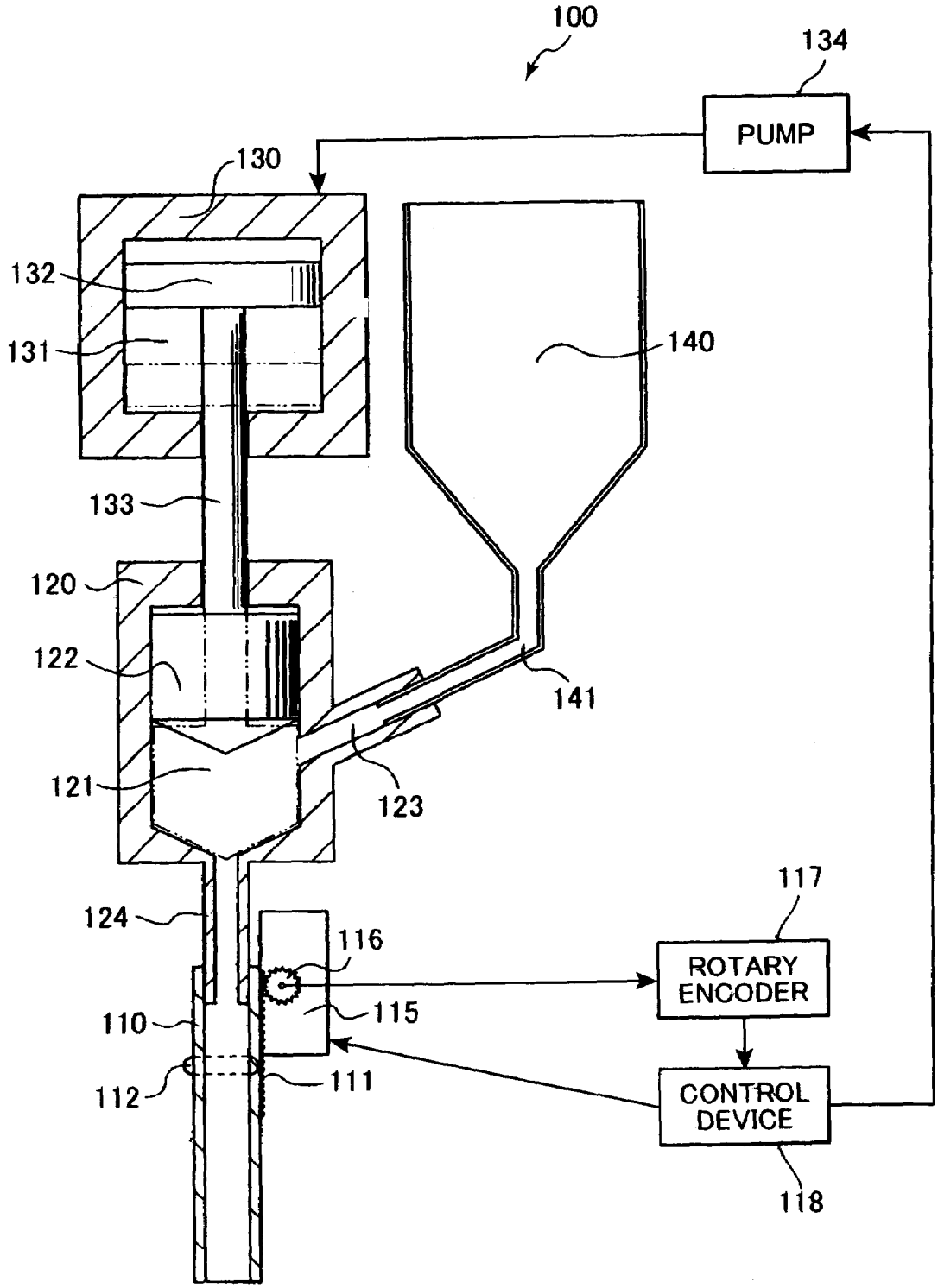
FIG. 6 is a cross-sectional view showing relevant parts of a toner filling device according to the first embodiment.

Next, the construction of a toner filling device 100 will be described with reference to FIG. 6. FIG. 6 is a cross-sectional view showing the relevant parts of the toner filling device 100. As shown in FIG. 6, the toner filling device 100 includes a slide nozzle 110, a toner expulsion device 120, a hydraulic cylinder 130, and a hopper 140.

The hopper 140 is a toner accommodating device having a cylindrical shape that narrows toward the bottom. The top of the hopper 140 is open for injecting toner. The narrow end on the bottom end of the hopper 140 is also open. A toner supply tube 141 cylindrical in shape is connected to the opening on the bottom of the hopper 140 and extends downward. At a midpoint, the toner supply tube 141 bends to a downward angle in order to supply toner to the toner expulsion device 120 disposed adjacent to the hopper 140.

The hydraulic cylinder 130 is a hydraulic driving device well known in the art that includes a cylinder 131, a piston 132, and a rod 133. Pressure from oil supplied from a pump 134 activates the piston 132 in the cylinder 131 and drives the rod 133 connected to the piston 132 to move in a linear direction.

The toner expulsion device 120 includes a cylinder 121 and a plunger 122. The cylinder 121 is a cylindrical chamber blocked on the top and bottom and having a central axis running vertically. An opening is formed in the top of the toner expulsion device 120, enabling the rod 133 of the hydraulic cylinder 130 to move in and out. The lower portion of the toner expulsion device 120 has a conical slanted surface formed on the inner wall. A cylindrical nozzle 124 extends downward from an open part formed in the bottom end of the toner expulsion device 120. The plunger 122 has a cylindrical shape that tapers on the bottom end and has substantially the same diameter as the inner diameter of the cylinder 121. The rod 133 is connected to the opposite end of the plunger 122. The driving force of the hydraulic cylinder 130 transferred to the plunger 122 via the rod 133 moves the plunger 122 vertically within the cylinder 121. A supply through-hole 123 is formed in the side surface of the cylinder 121, connecting the toner supply tube 141 of the hopper 140 to the cylinder 121. The plunger 122 also serves as a valve for the supply through-hole 123. That is, the supply through-hole 123 is opened when the plunger 122 is positioned in the topmost end in the moveable range of the plunger 122, enabling toner to be supplied into the cylinder 121 from the hopper 140. When the plunger 122 is positioned in the bottommost end of the moveable range of the plunger 122, the tapered part of the plunger 122 fits into the slanted surface of the cylinder 121, while the outer surface of the plunger 122 blocks the supply through-hole 123.

The slide nozzle 110 is a long narrow tube fitted over the nozzle 124 of the toner expulsion device 120 and capable of sliding reciprocally up and down. A rack gear 111 extends vertically along the outer surface of the slide nozzle 110. A pinion gear 116 engages with the rack gear 111 and is driven to rotate by a gear driving device 115. When the gear driving device 115 drives the pinion gear 116 to rotate, the slide nozzle 110 slides vertically. A rotary encoder 117 is disposed on the rotational shaft of the pinion gear 116 for measuring the amount that the pinion gear 116 rotates. By measuring this rotational amount, it is possible to adjust the distance in which the slide nozzle 110 moves. A rubber stopper 112 formed in a U-shape is provided over the outer surface near the top of the slide nozzle 110. As with such devices known in the art, the rotating shaft of the pinion gear 116 is configured to spin idly when a load greater than a predetermined amount is applied against the rotational torque. Hence, when the slide nozzle 110 is inserted into the developer cartridge 24, the sliding movement of the slide nozzle 110 is halted at a position in which the rubber stopper 112 contacts the casing of the developer cartridge 24. The position of the rubber stopper 112 is adjusted such that, when the rubber stopper 112 contacts the casing of the developer cartridge 24, the slide nozzle 110 is stopped with a slight gap remaining between the tip of the slide nozzle 110 and the bottom surface of the toner accommodating chamber 34.

Figure 7:
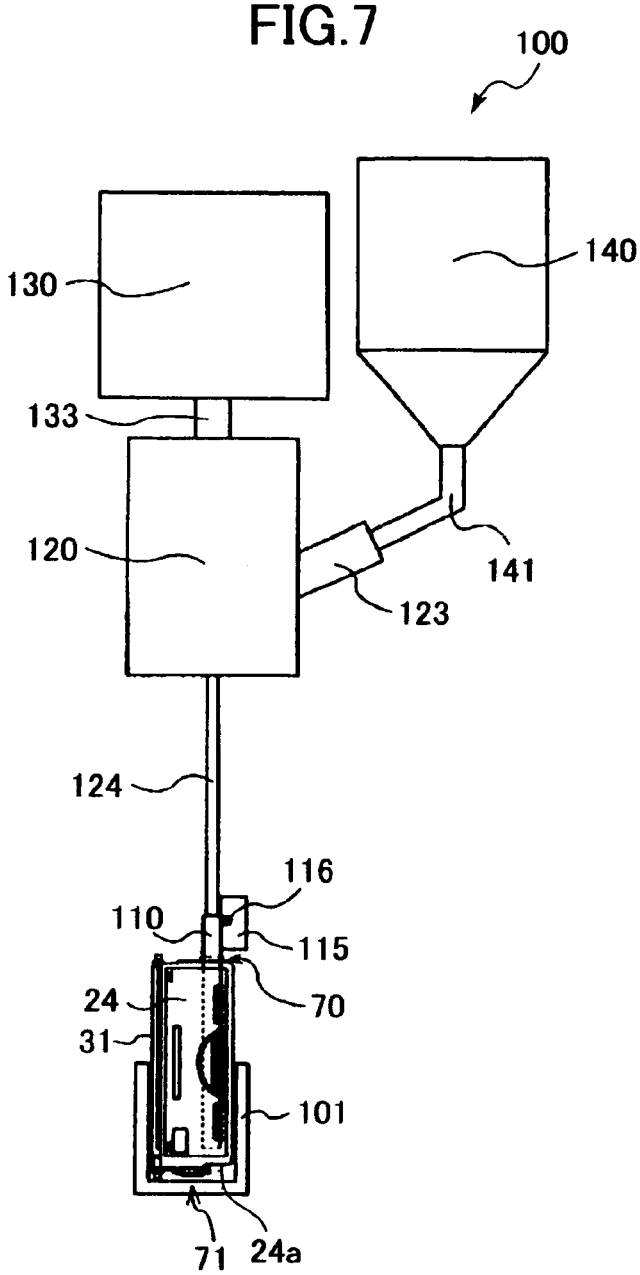
FIG. 7 is an explanatory diagram showing the toner filling device according to the first embodiment.

Next, a method for filling the developer cartridge 24 with toner will be described with reference to FIGS. 3, 6, and 7 FIG. 7 is an explanatory diagram showing an external view of the toner filling device 100. As shown in FIG. 7, the developer cartridge 24 is mounted in a holder 101 of the toner filling device 100, with the left side surface 24*a* on the bottom end, facing downward (arranging step). In this initial state, the piston 132 is in the bottommost position in the moveable range within the hydraulic cylinder 130, and the plunger 122 of the toner expulsion device 120 connected to the rod 133 is also in the bottommost position in the cylinder 121, as shown by the two-dot chain lines in FIG. 6.

Next, the gear driving device 115 drives the slide nozzle 110 disposed above the developer cartridge 24 to slide downward and to be inserted through the toner injecting through-hole 70 (inserting step). The sliding movement of the slide nozzle 110 is halted when the rubber stopper 112 provided on the body section of the slide nozzle 110 contacts the casing 50 of the developer cartridge 24. At this time, the rotary encoder 117 measures the movement of the slide nozzle 110.

Next, the piston 132 is moved upward, and the driving force of the piston 132 is transferred to the plunger 122 via the rod 133. When the plunger 122 moves to the topmost end of the moveable range within the cylinder 121, the supply through-hole 123 is in fluid communication with the cylinder 121, enabling toner in the hopper 140 to be supplied into the cylinder 121 via the toner supply tube 141. At this time, toner also flows into the toner accommodating chamber 34 of the developer cartridge 24 via the slide nozzle 110. However, since only a small gap is formed between the tip of the slide nozzle 110 and the bottom surface of the toner accommodating chamber 34, the tip of the slide nozzle 110 is substantially blocked by the bottom surface of the toner accommodating chamber 34. Since toner being supplied from the hopper 140 in this condition, the slide nozzle 110 and cylinder 121 are filled with toner.

Next, when the plunger 122 is moved downward along with the driving of the hydraulic cylinder 130, pressure is applied to the toner in the cylinder 121. At this time, the gear driving device 115 is driven in association with the operation of the hydraulic cylinder 130, sliding the slide nozzle 110 upward. Specifically, the piston 132 is moved by the pump 134 that is controlled by a control device 118, and the plunger 122 coupled with the rod 133 is also moved. The control device 118 also controls the gear driving device 115 to move the slide nozzle 110 gradually upward in association with the movement of the plunger 122, thereby expelling toner from the cylinder 121 out through the tip of the slide nozzle 110 (pressurizing and filling step).

The control device 118 can control the plunger 122 by adjusting the amount of oil supplied to the hydraulic cylinder 130 by the pump 134 and, therefore, can adjust the pressure applied to the toner being expelled. Further, the control device 118 can control the movement of the slide nozzle 110 by incorporating feedback received from the rotary encoder 117 into the driving of the gear driving device 115. When controlling movements of the plunger 122 and slide nozzle 110, the control device 118 controls the gear driving device 115 based on the relationship between the amount the plunger 122 moves and the amount of toner is expelled, as found in previous experiments and the like, such that the tip of the slide nozzle 110 is kept beneath the level of toner being gradually introduced into the toner accommodating chamber 34. As described above, the toner is introduced with pressure, while the nozzle tip is gradually raised to match the amount of toner introduced.

In this way, the toner filling device 100 fills the developer cartridge 24 with toner by injecting toner at a predetermined pressure into the toner accommodating chamber 34 in layers that are built up from the bottom surface of the toner accommodating chamber 34. Further, toner gradually introduced into the toner accommodating chamber 34 flows into the developing chamber 37 through the toner supply through-hole 47. At this time, the developer cartridge 24 is mounted such that the axis of the developer roller 31 extends vertically. The fixing ends for fixing the thickness regulating blade 32 and sealing member 40, which are provided for sealing gaps between the developer roller 31 and the wall surfaces of the casing 50 near the opening 28, on the casing 50 extend vertically.

The thickness regulating blade 32 is slanted toward the toner accommodating chamber 34, such that the free end 32*d* is positioned on the side of the toner accommodating chamber 34 with regard to an imaginary plane defined by the fixed end 32*c* and the axis of the developer roller 31. Similarly, the sealing member 40 is also slanted toward the toner accommodating chamber 34, such that its free end is positioned on the side of the toner accommodating chamber 34 with regard to an imaginary plane defined by its fixed end and the axis of the developer roller 31.

Therefore, since the pressure of toner introduced into the developing chamber 37 is applied in a direction toward the opening 28, pressure is applied in a direction pushing the free ends of the thickness regulating blade 32 and sealing member 40 against the outer surface of the developer roller 31. This construction prevents toner accommodated in the developing chamber 37 from leaking past the developer roller 31 into the opening 28.

By injecting toner into the developer cartridge 24 in this way, it is possible to fill the developer cartridge 24 with toner at a density about 1.5–2 times the apparent loose density (0.390 gram/$cm^3$) that is, a filled density generated by the toner's own particle weight. For example, when filling the developer cartridge 24 with 200 grams of toner, the toner accommodating chamber 34 requires a capacity of 700–800 $cm^3$, including additional room for margin, when filling the developer cartridge 24 with toner at the apparent loose density. However, when injecting the toner as described above, a capacity of 400–450 $cm^3$ is sufficient.

After completing the process of filling the developer cartridge 24 with toner, the slide nozzle 110 is slid upward, extracting the tip of the nozzle from the developer cartridge 24. The toner filling operation is completed by fitting the cap 70*a* into the toner injecting through-hole 70.

In the method of filling the developer cartridge 24 with toner described above, the slide nozzle 110 is inserted into the toner accommodating chamber 34 of the developer cartridge 24 that is mounted in the holder 101 of the toner filling device 100, wherein the right side surface 24*b* is on the top side, and pressurized toner is injecting by the toner expulsion device 120. At this time, the slide nozzle 110 is slid in a direction extracting the slide nozzle 110 from the developer cartridge 24, which is the upward direction, along with the movement of the plunger 122 that applies pressure to toner in the cylinder 121, thereby injecting toner into the toner accommodating chamber 34 at a density approximately 1.5–2 times the apparent loose density. When injecting toner according to this method, the tip of the slide nozzle 110 is positioned near the bottom surface of the toner accommodating chamber 34 and the slide nozzle 110 slides to be extracted from the developer cartridge 24 in association with the amount of injected toner. Accordingly, the tip of the nozzle is positioned in the layer of toner formed in the developer cartridge 24, detering the generation of a toner-air mixture by making it difficult for toner particulate to mix with air.

Further, the gear train 71 is provided on the left side surface 24*a* for transferring a driving force to the developer roller 31 and agitator 36 of the developer cartridge 24. Hence, when introducing toner through the toner injecting through-hole 70 on the right side surface 24*b*, it is possible to prevent the small amount of generated toner-air mixture from contaminating grease or the like applied to the gear train 71.

Also, the slide nozzle 110 is inserted via the toner injecting through-hole 70 such that the tip of the slide nozzle 110 is positioned in a layer of toner filled in the toner accommodating chamber 34. Accordingly, the toner is less likely to mix with air in the toner accommodating chamber 34, thereby making it possible to suppress the generation of a toner-air mixture and increase the toner density.

The tip of the slide nozzle 110 is raised up in conjunction with a rise in level of the toner when introducing toner. Accordingly, an increased amount of toner equivalent to the volume of the slide nozzle 110 can be introduced than when introducing toner while maintainig the nozzle tip at a predetermined position in the toner accommodating chamber 34 and withdrawing the slide nozzle 110 after the filling operation is completed.

Toner introduced into the toner accommodating chamber 34 is prevented from being discharged to outside by the filter 73 when air is discharged from the toner accommodating chamber 34. Accordingly, environmental contamination caused by the toner-air mixture can be prevented.

The toner introduced into the toner accommodating chamber 34 is a polymer toner with excellent fluidity. Accordingly, the density of the toner introduced into the toner accommodating chamber 34 can be increased by pressure applied during the toner filling operation.

Further, the lifetime of the developer cartridge 24 can be increased by increasing the capacity for accommodating toner. Alternatively, by decreasing a volume occupied by toner, the toner accommodating chamber 34 can be reduced in size, thereby enabling size reduction of the laser printer 1.

Next, modifications of the first embodiment will be described below.

Figure 8:
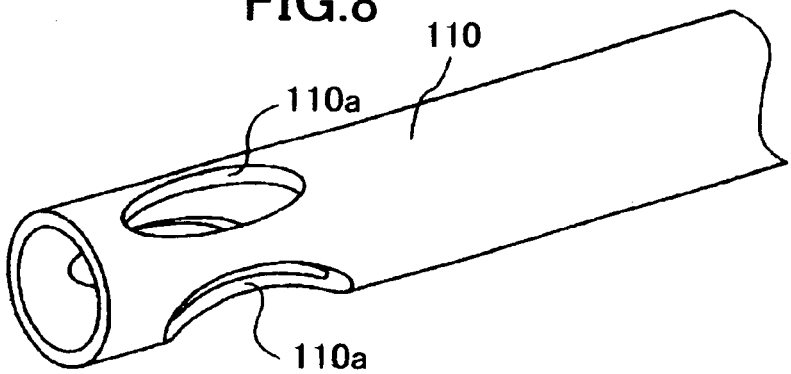
FIG. 8 is a perspective view showing a modification of a slide nozzle of the first embodiment.

As shown in FIG. 8, nozzle tip openings 110*a* can be formed in an outer part on the tip of the slide nozzle 110. When inserting the slide nozzle 110 having this construction into the developer cartridge 24, the tip of the slide nozzle 110 can be placed in contact with the bottom surface of the toner accommodating chamber 34. In this way, the pressure of toner applied to the tip of the nozzle can be dispersed by the nozzle tip openings 110*a*, thereby reducing the possibility of toner becoming packed or clogged in the nozzle tip.

Figure 9:
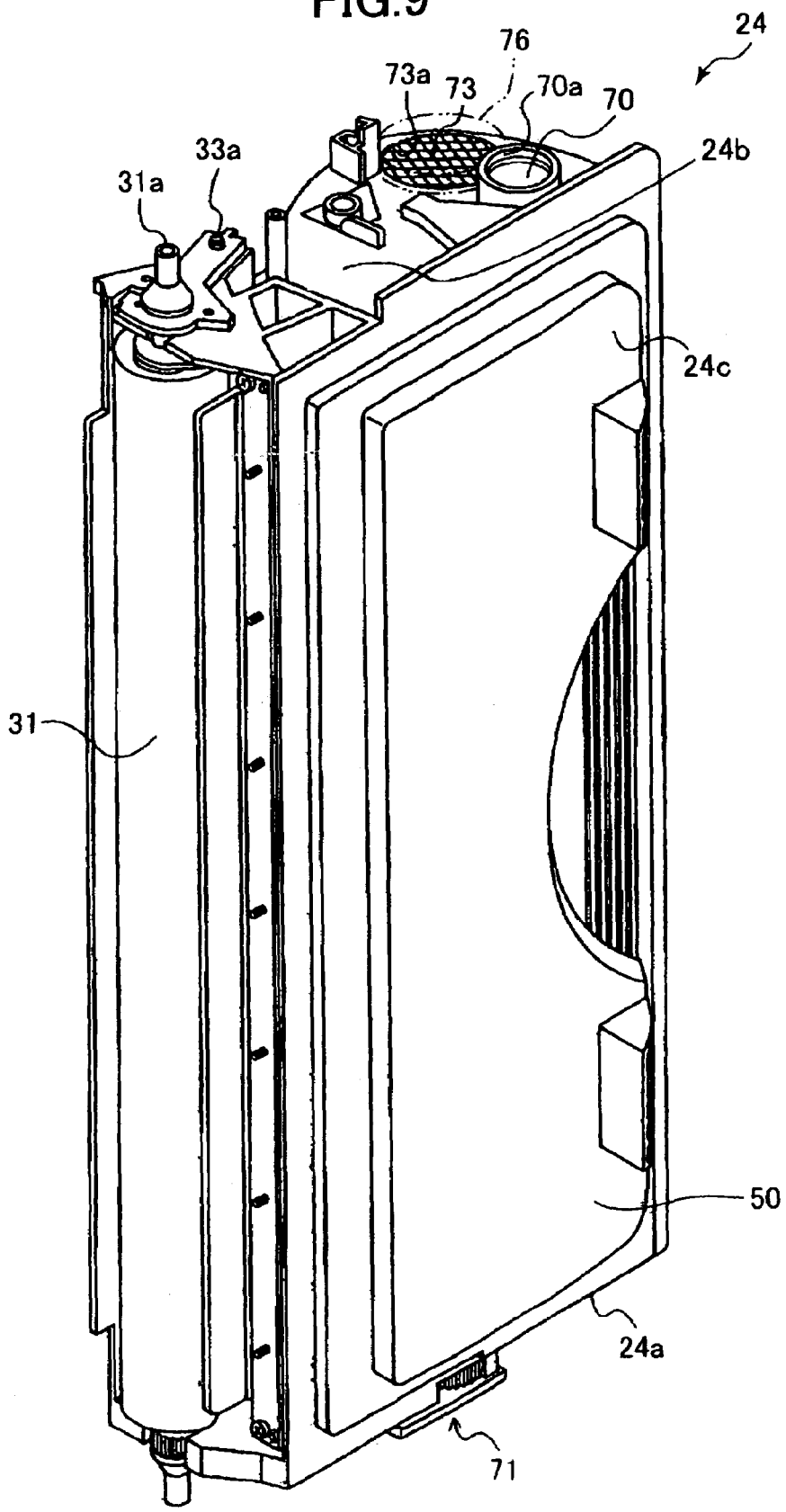
FIG. 9 is a perspective view showing a modification of the developer cartridge of the first embodiment.

As shown in FIG. 9, it is possible to provide an exhausting through-hole 73*a* in the right side surface 24*b* that is in fluid communication with the toner accommodating chamber 34, and a filter 73 disposed in the exhausting through-hole 73*a*. For example, a filter that allows air to pass but not toner particulate, such as a GS-25 (trade name) glass fiber filter manufactured by Tokyo Roshi Kabushiki Kaisha, can be fixed in the exhausting through-hole 73*a*. When introducing toner, the tip of the slide nozzle 110 can be tightly fitted in the toner injecting through-hole 70. With this construction, a toner-air mixture is generated in the toner accommodating chamber 34 when injecting toner during the toner filling process, but this toner-air mixture does not leak out from the toner injecting through-hole 70 because the tip of the slide nozzle 110 is tightly fitted therein. Since air in the toner accommodating chamber 34 is discharged through the exhausting through-hole 73*a* with the filter 73, the atmospheric pressure in the toner accommodating chamber 34 can be maintained in equilibrium with the external atmospheric pressure. Further, since only air passes through the filter 73, toner particulate does not leak therefrom. In addition, since the size of the exhausting through-hole 73*a* is greater than the size of the toner injecting through-hole 70, the developer cartridge 24 can function sufficiently to discharge air of an amount equivalent to the volume of toner introduced through the toner injecting through-hole 70 to the outside of the casing 50 via the filter 73. With this construction, damage to the filter 73 can be prevented by reducing the load applied thereto. Further, tears in the filter 73 and other problems can be prevented by covering the filter 73 with a cover 76 during shipping.

Figure 10:
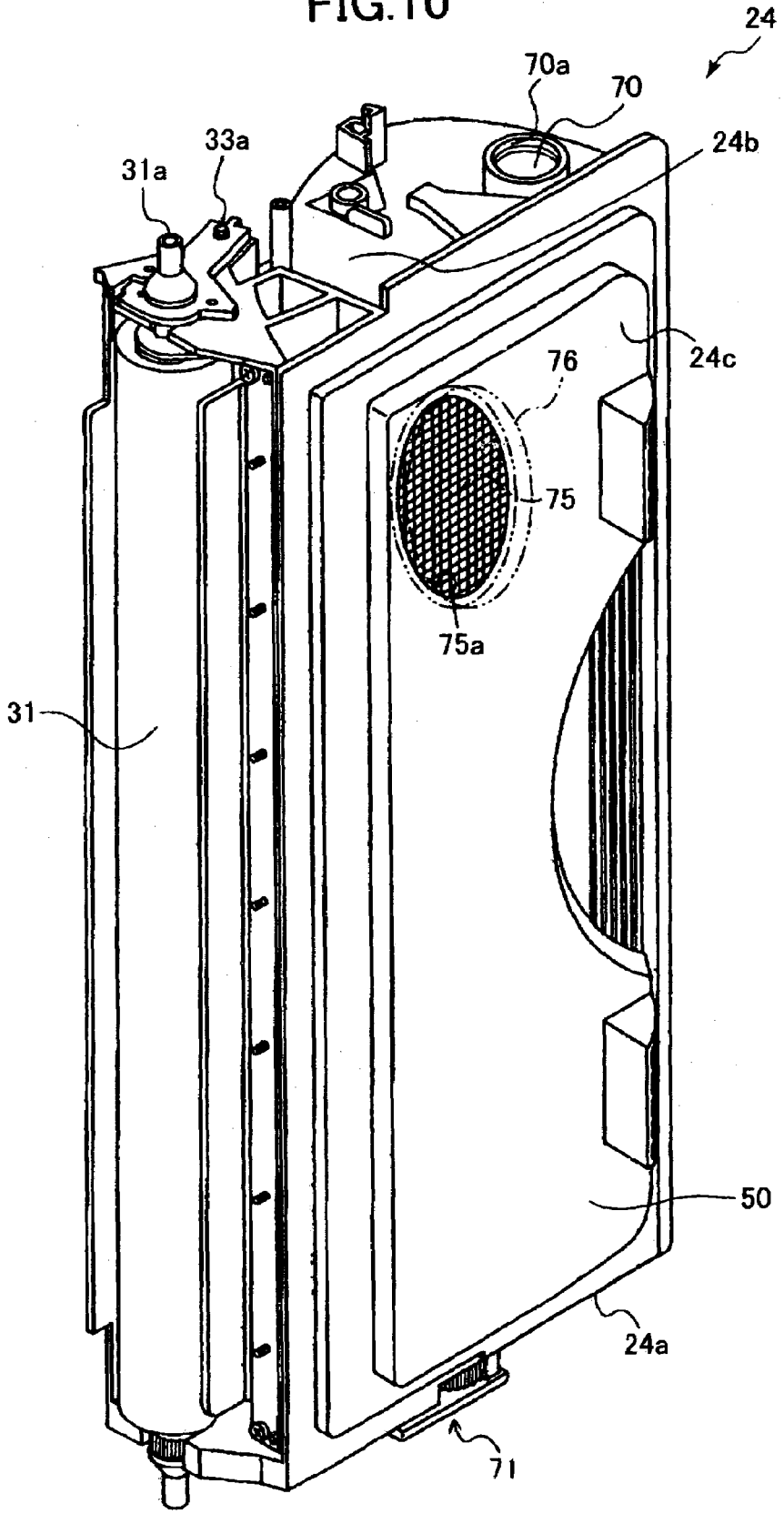
FIG. 10 is a perspective view showing another modification of the developer cartridge of the first embodiment.

As shown in FIG. 10, an exhausting through-hole 75*a* in fluid communication with the toner accommodating chamber 34 is formed in the upper part of an upper cover 24*c* of the developer cartridge 24 and positioned near the right side surface 24*b*. As in the modification of FIG. 9, a filter 75 that allows air to pass through but not toner particulate is disposed in the exhausting through-hole 75*a*. When introducing toner, the developer cartridge 24 is stood up lengthwise, such that the toner injecting through-hole 70 side is on the top, facing upward. However, since the filter 75 is positioned near the top of the developer cartridge 24 when the developer cartridge 24 is placed in this position, the same effects as those described in the modification of FIG. 9 can be achieved. By setting the amount of toner introduced into the developer cartridge 24 such that the maximum level of the toner layer is below the position of the exhausting through-hole 75*a* provided with the filter 75, it is possible to prevent damage and other problems caused by a load applied to the filter 75 when the filter 75 becomes buried in toner. As described above, the cover 76 covers the filter 75 during shipping to prevent toner leakage and other problems.

Figure 11:
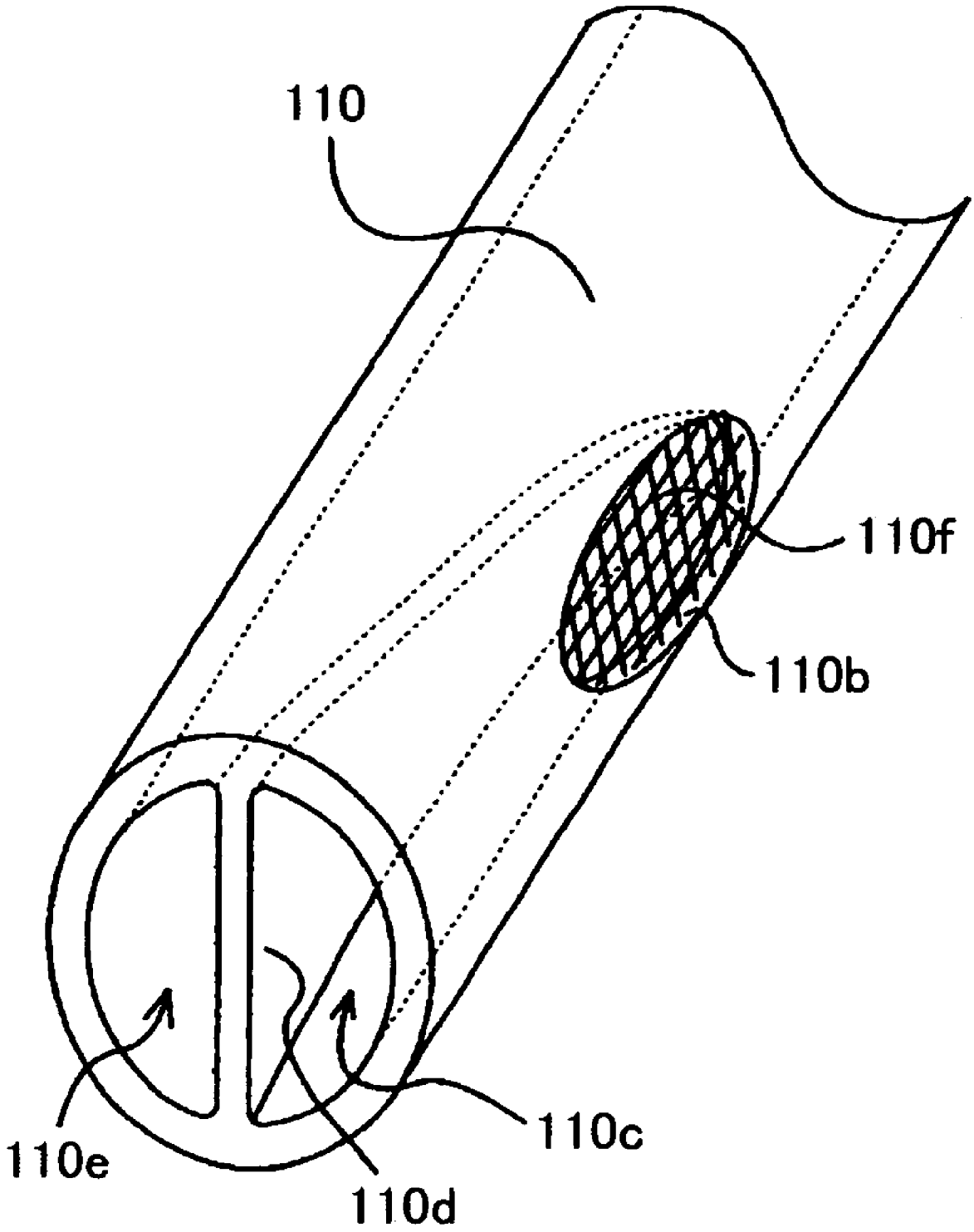
FIG. 11 is a perspective view showing another modification of the slide nozzle of the first embodiment.

As shown in FIG. 11, the passage in the cylindrical nozzle at the tip of the slide nozzle 110 can be split by a partitioning plate 10*d*. One side of the partitioning plate 110*d* is a passage 110*c* communicated with an exhausting through-hole 110*b* that is formed in the side surface of the nozzle at a predetermined distance from the nozzle tip. The other side of the partitioning plate 110*d* is a passage 110*e* that is communicated with the toner expulsion device 120. Hence, the passages 110*e* and 110*c* are partitioned by the partitioning plate 110*d*, and a filter 110*f* identical to that used in the modification of FIG. 9 is provided in the exhausting through-hole 110*b*, allowing air to pass into and out of the passage 10*c*. Further, when introducing toner, the slide nozzle 110 is configured such that the tip fits tightly with the toner injecting through-hole 70. When introducing toner using the slide nozzle 110 having this construction, a toner-air mixture does not leak from the toner injecting through-hole 70 in tight contact with the tip of the slide nozzle 110, even when such toner-air mixture is generated in the toner accommodating chamber 34 due to the injection of toner. Since air in the toner accommodating chamber 34 is exhausted through the filter 110*f* in the exhausting through-hole 110*b* and via the passage 110*c*, the pressure in the toner accommodating chamber 34 can be maintained in equilibrium with the external atmospheric pressure. When using the slide nozzle 110 having this construction, the same effects described for the modification of FIG. 9 can be achieved without providing a filter or the like in the developer cartridge 24.

Figure 12:
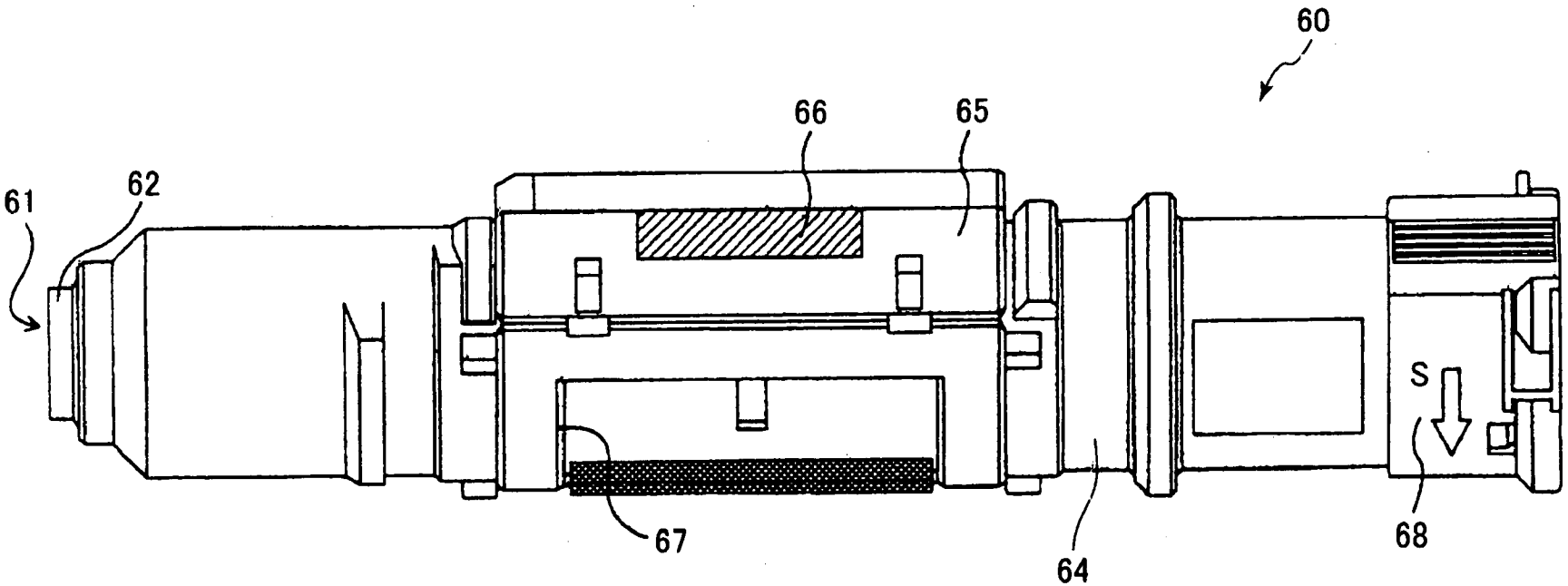
FIG. 12 is a front view showing a toner cartridge.

A developer cartridge configured such that the toner accommodating chamber 34 can be detached from the developer cartridge 24. For example, a toner cartridge 60 shown in FIG. 12 can be filled with toner using the developer filling method of the present embodiment. A casing 64 of the toner cartridge 60 is a long slender vessel having a substantially cylindrical shape. A toner injecting through-hole 61 is formed in a wall surface on one lengthwise end of the casing 64. A toner supply through-hole 66 is formed approximately in the center portion of the outer surface in the lengthwise direction of the casing 64. A slide cover 65 having an opening 67 covers the body section of the casing 64 to block the toner supply through-hole 66. The slide cover 65 is capable of rotating sliding against the casing 64. When being filled with toner, the toner cartridge 60 is stood up lengthwise, such that the toner injecting through-hole 61 is positioned on the top thereof to face upward, and toner is introduced according to the first embodiment. After the toner filling process is completed, the toner injecting through-hole 61 is covered with a cap 62 for shipping. When using the toner cartridge 60, a user holds the slide cover 65 with one hand while rotating a grip part 68 in the direction indicated by an arrow S. By rotating the slide cover 65 over the outer surface of the casing 64, the toner supply through-hole 66 can be exposed through the opening 67. In this condition, the toner cartridge 60 is set in the device, or alternatively is made to this state after being set in the device, enabling toner to be supplied to the device. In this modification, the inside space defined by the casing 64 corresponds to the toner accommodating chamber 34 in the first embodiment. Also, the toner supply through-hole 66 corresponds to the toner supply through-hole 47 in the first embodiment.

When filling toner with the present embodiment, the toner is injected into the developer cartridge 24 as the slide nozzle 110 is gradually withdrawn therefrom. However, the slide nozzle 110 can be withdrawn after the toner filling operation is completed. Further, a laser printer 1 for achieving single-color printing is described as an example of the preferred embodiment, but the present embodiment can be suitably applied to a device for performing color printing using four colors of developer, including cyan, magenta, yellow, and black, and the toner cartridges for that device, enabling the size of this device to be reduced.

In the above-mentioned modification, the exhausting through-hole 73*a* has a greater area than the area of the opening in the slide nozzle 110. Accordingly, the load applied to the filter 73 when discharging air can be reduced, thereby preventing clogging and damage to the filter 73.

Also, toner is forced out through the slide nozzle 110 such that the maximum level of toner introduced into the toner accommodating chamber 34 is at a position lower than the tip of the slide nozzle 110 fitted into the toner injecting through-hole 70 and lower than the exhausting through-hole 73*a*. Accordingly, blockage in the nozzle tip and exhausting through-hole 73*a* by toner can be prevented.

A developer filling method, a developer cartridge, and an image forming device employing the developer cartridge according to a second embodiment will be described while referring to the accompanying drawings wherein like parts and components are designated by the same reference numerals to avoid duplicating description. The basic construction of a laser printer 201 according to the second embodiment is the same as that of the laser printer 1 according to the first embodiment, so detailed descriptions are omitted.

Figure 13:
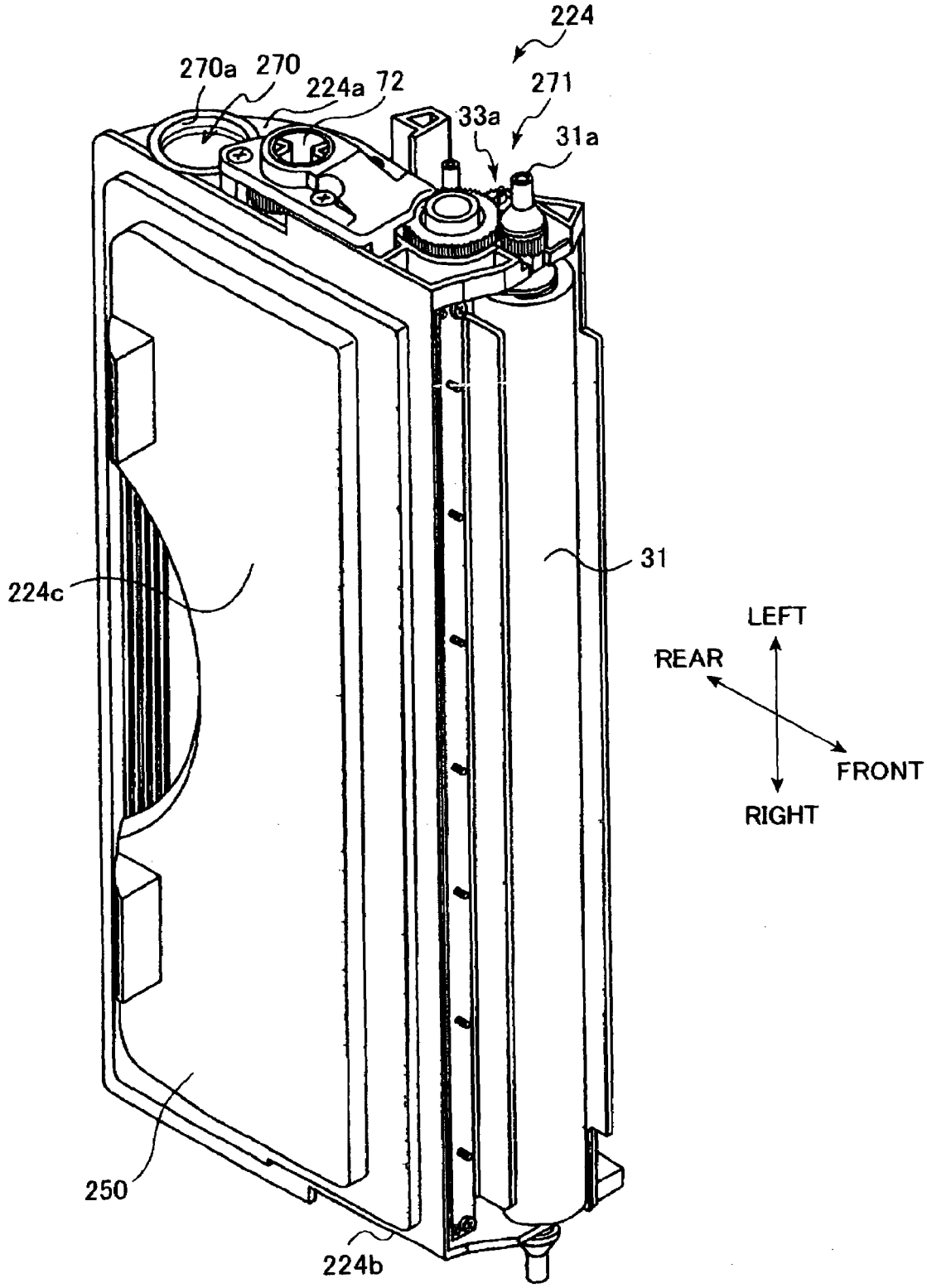
FIG. 13 is a perspective view showing a developer cartridge according to a second embodiment of the present invention.
Figure 14:
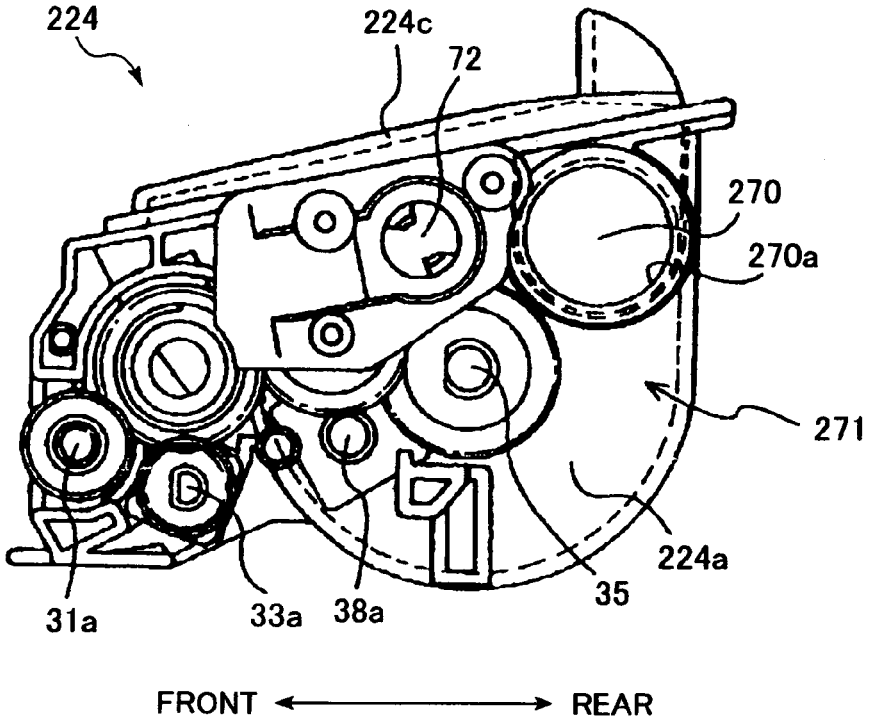
FIG. 14 is a left side view showing the developer cartridge according to the second embodiment.

FIG. 13 is a perspective view showing a developer cartridge 224 by the second embodiment. In the first embodiment, the toner injecting through-hole 70 is formed in the right side surface 24*b* of the developer cartridge 24, which is the opposite side of the left side surface 24*a* on which the gear train 71 is provided. In the second embodiment, on the other hand, a toner injecting through-hole 270 is formed in a left side surface 224*a*, which is the same side on which a gear train 271 is provided.

The toner injecting through-hole 270 in fluid communication with the toner accommodating chamber 34 is formed in the left side surface 224*a* at a position that does not interfere with the gear train 271. In the manufacturing process of the developer cartridge 224, the toner accommodating chamber 34 defined by a casing 250 is filled with toner through the toner injecting through-hole 270, after which the toner injecting through-hole 270 is sealed by a cap 270*a* formed of polypropylene or another material.

As with the left side surface 224*a*, bearing through-holes for the shaft 31*a* of the developer roller 31 and the shaft 33*a* of the supply roller 33 penetrate the right side surface 224*b*.

Figure 15:
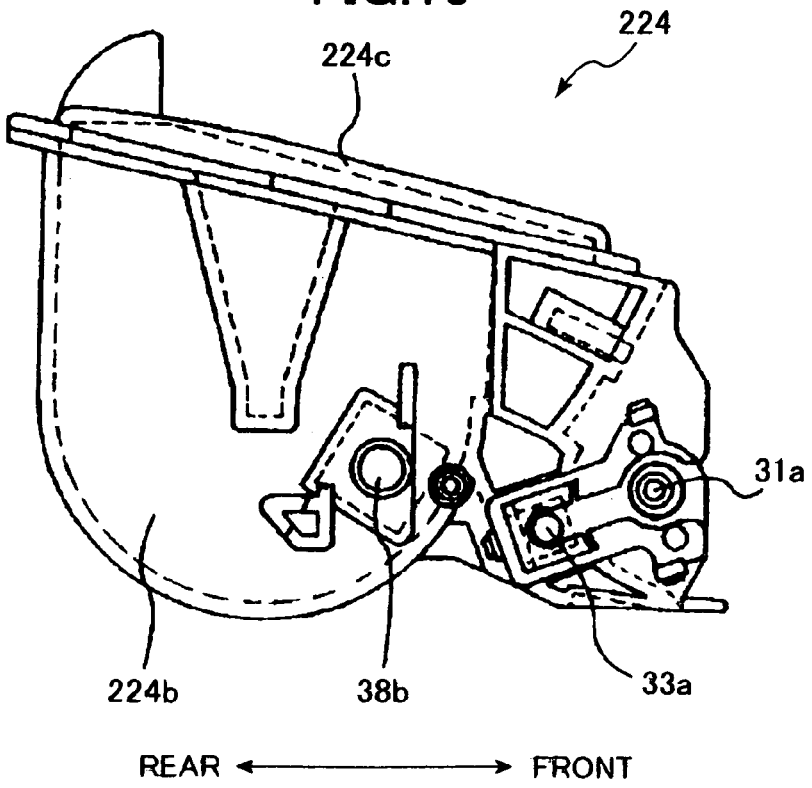
FIG. 15 is a right side view showing the developer cartridge according to the second embodiment.
Figure 16:
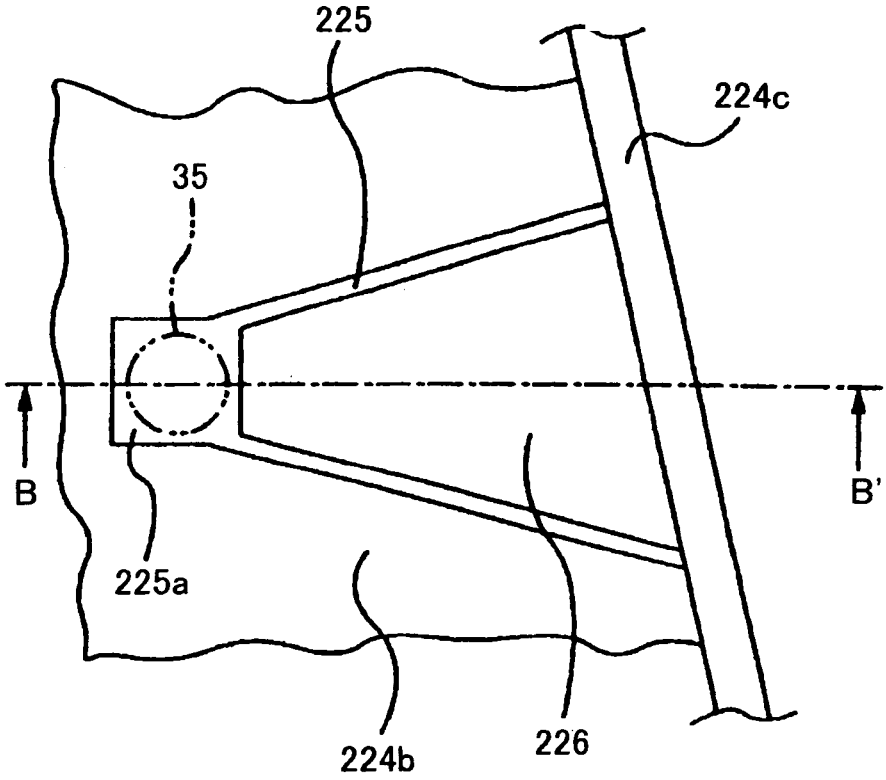
FIG. 16 is an enlarged plan view showing a shaft guiding groove, a support unit, and the like according to the second embodiment.
Figure 17:
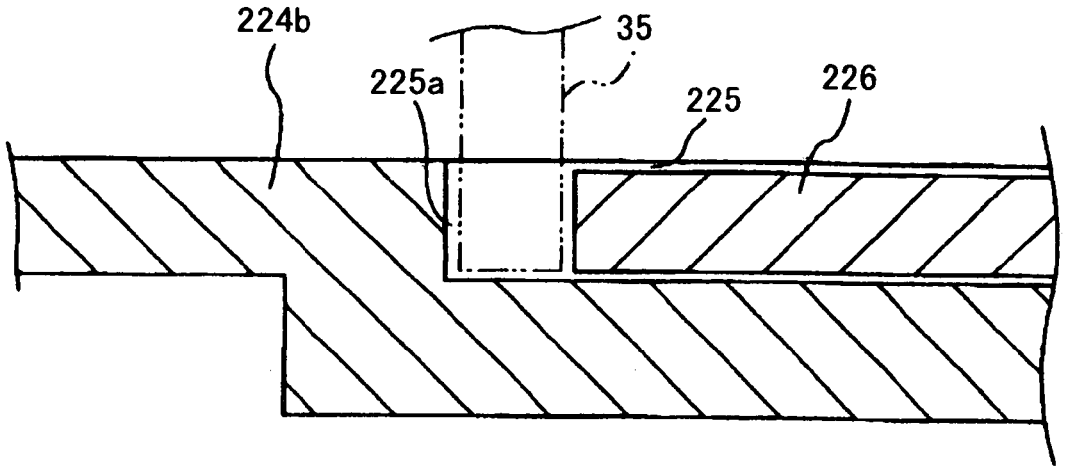
FIG. 17 is a cross-sectional view along a single-dot chain line B–B' in FIG. 16.

A bearing through-hole for the rotating shaft 35 of the agitator 36 does not penetrate the right side surface 224*b*. Rather, a depression is formed in the inner wall surface of the toner accommodating chamber 34. As shown in FIGS. 16 and 17, a shaft guiding groove 225 having a concave shape that narrows from the juncture point between the right side surface 224*b* and the upper cover 224*c* of the developer cartridge 224 (see FIGS. 13 and 15) toward a support unit 225*a*, which is a portion in which the rotating shaft 35 of the agitator 36 contacts the right side surface 224*b*, is formed on the inner side surface of the right side surface 224*b* on the casing of the developer cartridge 224. When assembling the developer cartridge 224, one end of the rotating shaft 35 is inserted into the bearing through-hole formed in the left side surface 224*a*, while the other end is positioned in the support unit 225*a* by moving along the shaft guiding groove 225 of the right side surface 224*b*. By inserting the upper cover 224*c* integrally formed with a stopper 226 that fits into the shaft guiding groove 225, the stopper 226 is fixed and the rotating shaft 35 is rotatably supported at the position of the support unit 225*a*.

Figure 18:
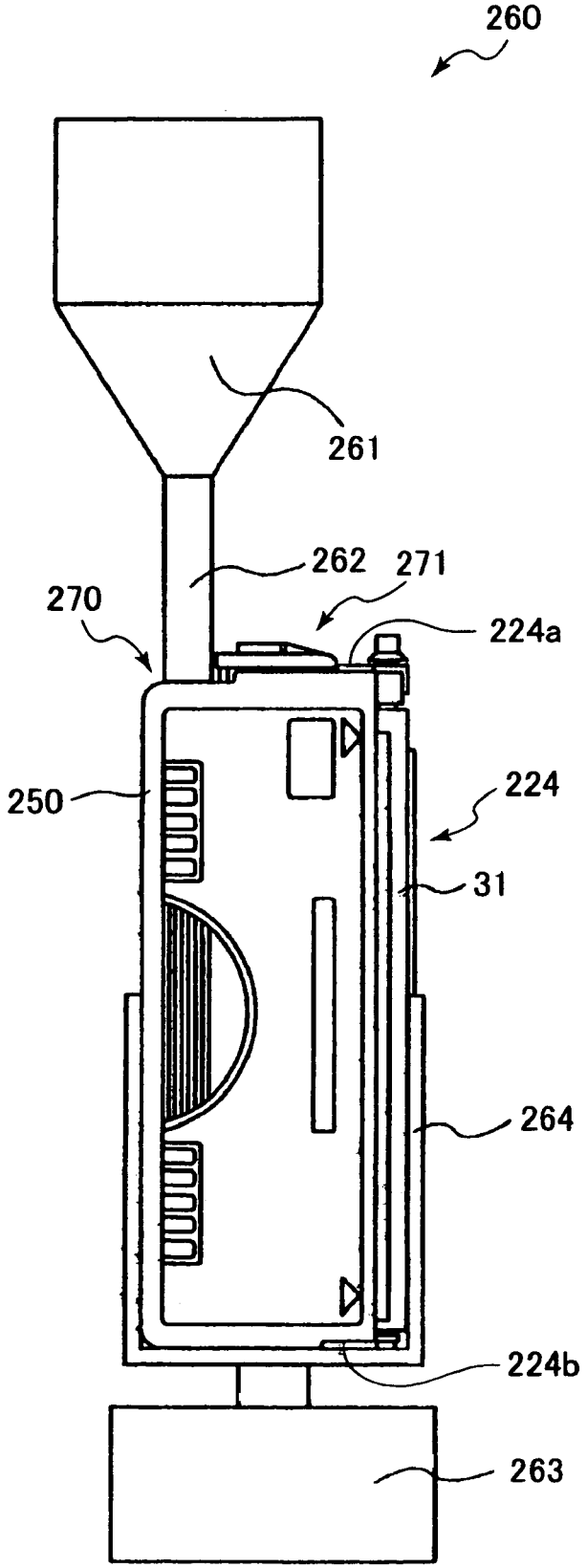
FIG. 18 is an explanatory diagram showing the construction of a toner filling device according to the second embodiment.

Next, the construction of a toner filling device 260 will be described while referring to FIG. 1B. FIG. 18 is an explanatory diagram showing the construction of the toner filling device 260. As shown in FIG. 18, the toner filling device 260 includes a vibration generating device 263 including a holder 264 capable of holding the developer cartridge 224, and a hopper 261 provided with a nozzle 262 that is inserted into the toner injecting through-hole 270 of the developer cartridge 224.

The vibration generating device 263 is a device generating vibrations employing an eccentric motor system capable of generating 100 Hz vibrations, for example. The vibration generating device 263 transfers vertical vibrations to the holder 264. The hopper 261 accommodates toner to be supplied to the developer cartridge 224 and introduces toner into the toner accommodating chamber 34 in the developer cartridge 224 via the nozzle 262.

Next, a method for filling the developer cartridge 224 with toner will be described with reference to FIGS. 13 and 18. First the developer cartridge 224 is placed in the holder 264 such that the right side surface 224*b* faces downward. Next, the hopper 261 disposed above the developer cartridge 224 is moved downward, inserting the nozzle 262 into the toner injecting through-hole 270. By opening a valve (not shown) inside the hopper 261, toner accommodated in the hopper 261 falls naturally by its own weight into the toner accommodating chamber 34 in the developer cartridge 224 via the nozzle 262. By operating the eccentric motor (not shown) of the vibration generating device 263, vertical vibrations of approximately 100 Hz are transferred to the casing 250 of the developer cartridge 224 via the holder 264.

Toner introduced gradually into the toner accommodating chamber 34 flows into the developing chamber 37 via the toner supply through-hole 47. At this time, the developer cartridge 224 is oriented such that the axis of the developer roller 31 is vertical. The fixing portions for fixing the thickness regulating blade 32 and sealing member 40, which are provided for sealing gaps between the developer roller 31 exposed in the opening 28 of the developer cartridge 224 and the casing walls near the opening 28, are vertically oriented. Accordingly, the free ends of the thickness regulating blade 32 and sealing member 40 bend in the horizontal direction, orthogonal to the direction of the vibrations. Hence, the thickness regulating blade 32 and sealing member 40 are not bent easily by the vibrations, making it less likely that gaps will appear between the external surface of the developer roller 31 and the thickness regulating blade 32, or the external surface of the developer roller 31 and the sealing member 40.

Since the shaft guiding groove 225 forms a concave shape in the toner accommodating chamber 34 and does not penetrate the casing 250 in the right side surface 224*b*, which is positioned on the bottom when the developer cartridge 224 is mounted in the holder 264, toner does not leak through the casing 250 from the toner accommodating chamber 34. Since the bearing through-holes for the shaft 31*a* of the developer roller 31 and the shaft 33*a* of the supply roller 33 are formed in the right side surface 224*b* within the developing chamber 37, pressure from toner introduced into the toner accommodating chamber 34 is alleviated when the toner passes through the toner supply through-hole 47 before entering the developing chamber 37. Accordingly, toner is less likely to leak from the bearing through-holes.

By transferring vertical vibrations from the vibration generating device 263, individual particles in the toner introduced into the toner accommodating chamber 34 are more tightly packed and can be filled more densely than when vibrations are not applied. In this case, toner can be introduced at a density of about 1.5–2 times the density achieved by the weight of the toner particles, that is, the apparent loose density (0.390 gram/$cm^3$). Further, since the gear train 271 is positioned on top during the toner filling process, grease and the like applied to the gear train 271 is not contaminated in the unlikely event that toner leaks when vibrating the developer cartridge 224. This eliminates the need to re-clean the gear train 271 and facilitates repairing.

After the developer cartridge 224 has been filled with toner, the vibrations of the vibration generating device 263 are stopped and the hopper 261 is moved upward. The nozzle 262 is removed from the developer cartridge 224. By fitting the cap 270*a* into the toner injecting through-hole 270, the toner filling operation is completed.

In the toner filling method for the developer cartridge 224 described above, the developer cartridge 224 is mounted in the holder 264 of the toner filling device 260, such that the left side surface 224*a* is facing upward, and vertical vibrations are applied to the casing 250 of the developer cartridge 224 by the vibration generating device 263. The toner is then introduced through the toner injecting through-hole 270 provided in the left side surface 224*a*, thereby achieving a density of toner particles greater than the apparent loose density. Further, by providing the gear train 271 on the left side surface 224*a* of the casing 250 of the developer cartridge 224, it is possible to prevent contamination of grease and the like applied on the gear train 271.

Since the bearing for the rotating shaft 35 of the agitator 36 does not penetrate the right side surface 224*b*, leakage of toner can be prevented during the tilling process. Further, the toner supply through-hole 47 linking the toner accommodating chamber 34 to the developing chamber 37 is narrower than the diameter of the developer roller 31. The amount of toner supplied from the toner accommodating chamber 34 to the developing chamber 37 is regulated, thereby lessening the pressure applied by the toner to the developing chamber 37.

The developer cartridge 224 is arranged, such that the axis of the developer roller 31 is substantially parallel to the gravitational direction. Accordingly, the lengthwise direction of the developer cartridge 224 is vertical, enabling the toner to be compressed more densely using the weight of the toner itself.

The developer cartridge 224 is arranged such that the axis of the developer roller 31 is substantially aligned with the gravitational direction and the opening 28 is positioned on the side to face horizontally. Accordingly, the gravitational effects of toner are reduced, thereby preventing the toner from leaking between the developer roller 31 and the thickness regulating blade 32, or the developer roller 31 and the sealing member 40.

Also, toner having substantially spherically shaped particles is used for filling the developer cartridge 224. Accordingly, since the spherically shaped particles have good fluidity, the filling density of toner can be increased through vibrations.

The lifetime of the developer cartridge 224 can be increased by increasing the amount of toner in the toner accommodating chamber 34, or the size of the laser printer 201 can be reduced by decreasing the volume occupied by toner.

Next, modifications of the second embodiment will be described below.

The vibration generating device 263 can employ an electromagnetic system, an ultrasonic system, or a piezoelectric system in place of the eccentric motor system, provided that vibrations can be applied to the developer cartridge 224. The direction of the vibrations also need not be vertical. When introducing toner, it is also possible to apply vibrations to the developer cartridge 224 intermittently.

Also, the toner supply through-hole 47 can be formed in a mesh shape or a slitted shape, provided that pressure of toner applied to the developing chamber 37 can be regulated. Further, the above-described method can be used to introduce toner into the processing cartridge 17 formed integrally of the developer cartridge 224 and the drum cartridge 23.

The second embodiment relates to the developer cartridge 224. However, the present embodiment can be applied to a vessel for accommodating toner such as the toner cartridge 60 shown in FIG. 12.

A developer accommodating vessel, a developer cartridge, a processing device, an image forming device, and a developer filling method according to a third embodiment will be described while referring to the accompanying drawings.

Figure 19:
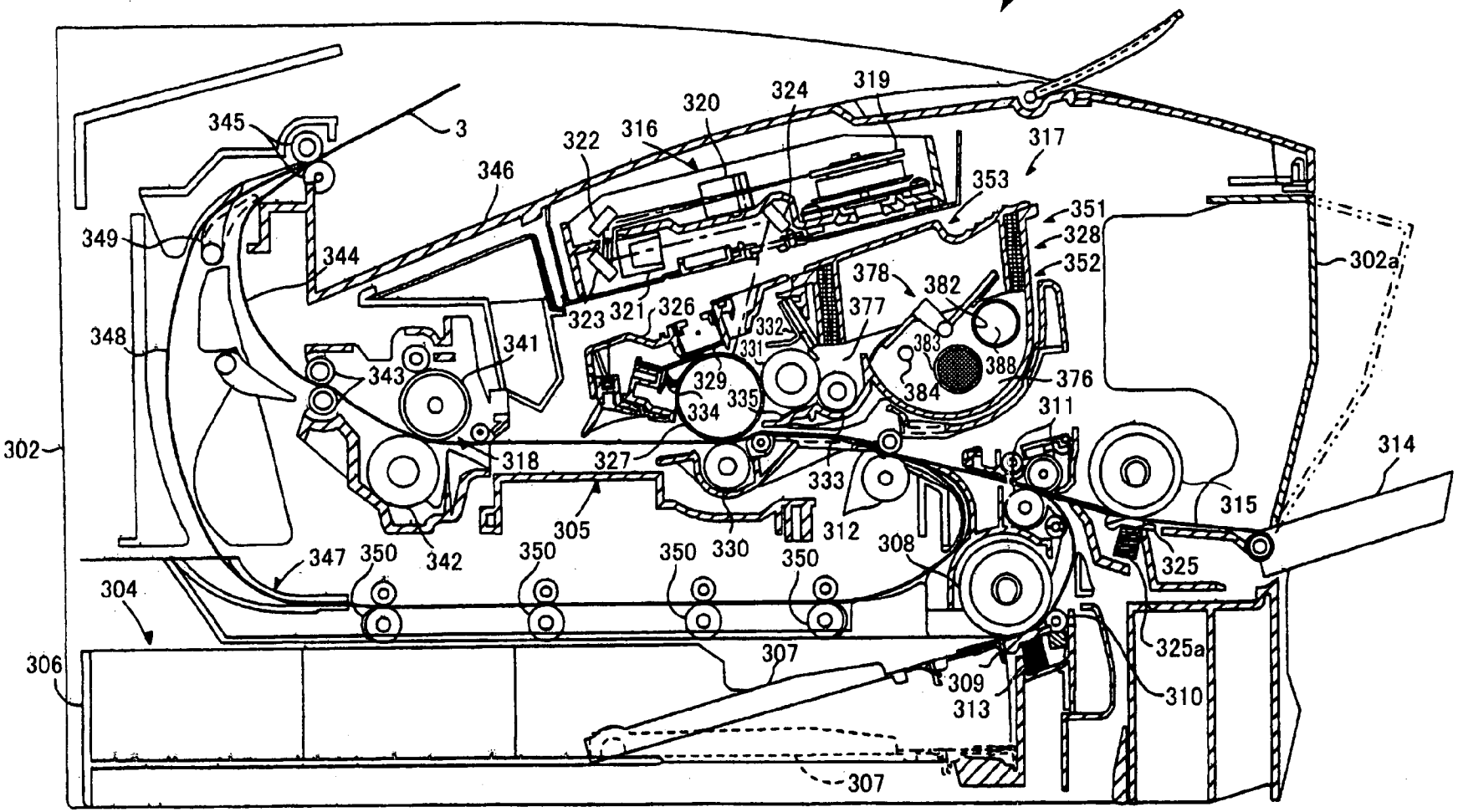
FIG. 19 is a side cross-sectional view showing a laser printer according to a third embodiment of the present invention.

FIG. 19 is a side cross-sectional view showing a laser printer 301 according to the third embodiment. In FIG. 19, the laser printer 301 includes a main case 302 and, within the main case 302, a feeder unit 304 for feeding a paper 3, an image forming unit 305 for forming images on the supplied paper 3, and the like.

The feeder unit 304 according to the third embodiment is constituted in the similar way as the feeder unit 304 according to the first embodiment. But the feeder unit 304 further includes a multipurpose tray 314 and a multipurpose feed roller 315 and a multipurpose feed pad 325 for feeding the paper 3 stacked on the multipurpose tray 314. The multipurpose feed roller 315 and multipurpose feed pad 325 are disposed in opposition to each other. A spring 325*a* disposed on the underside of the multipurpose feed pad 325 presses the multipurpose feed pad 325 against the multipurpose feed roller 315. The rotation of the multipurpose feed roller 315 feeds a single sheet of the paper 3 stacked on the multipurpose tray 314 in between the multipurpose feed roller 315 and the multipurpose feed pad 325.

For convenience of the description, the side of the laser printer 301 in which the multipurpose feed roller 315 is provided will be referred to as the back side and the side in which the fixing unit 318 is provided the front side.

The image forming unit 305 includes a scanning unit 316, a processing cartridge 317 as the processing device, a fixing unit 318, and the like.

Figure 20:
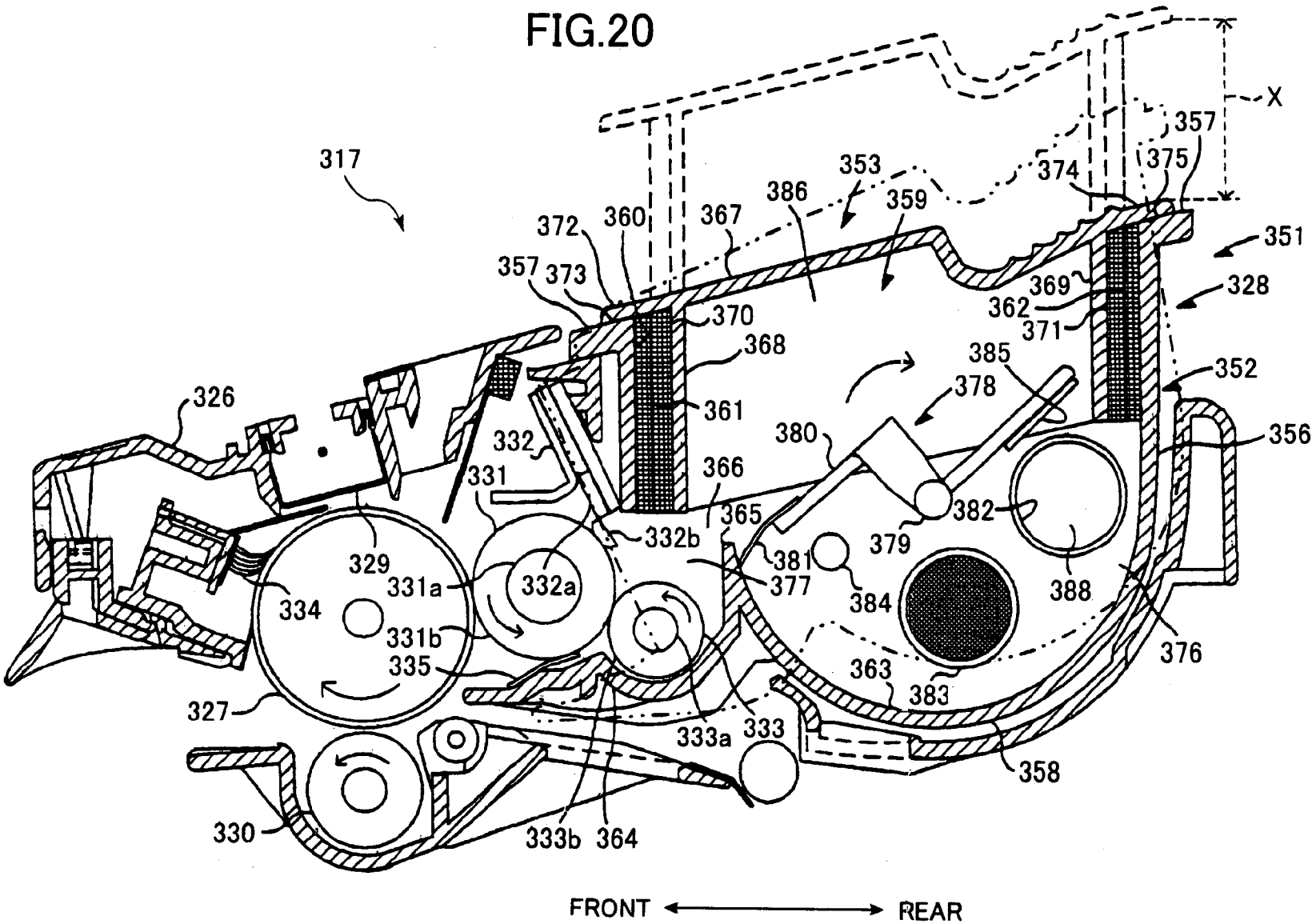
FIG. 20 is a side cross-sectional view showing a processing unit according to the third embodiment.

The processing cartridge 317 is disposed below the scanning unit 316. As shown in FIG. 20, the processing cartridge 317 includes a drum cartridge 326 detachably mounted in the main case 302 and, within the drum cartridge 326, the photosensitive drum 327, a developer cartridge 328, a Scorotron type charging device 329, the transfer roller 330, a conductive brush 334, and the like.

As shown in FIG. 19, a side cover 302*a* that can be opened and closed is provided on the back wall of the laser printer 301. When the side cover 302*a* is open, the processing cartridge 317 can be mounted in or removed from the main case 302. When the processing cartridge 317 is removed from the main case 302, the developer cartridge 328 can be mounted on or removed from the drum cartridge 326 of the processing cartridge 317, as illustrated by the two-dot chain lines in FIG. 20.

Hence, when replacing the developer cartridge 328, for example, first the processing cartridge 317 is removed from the main case 302. Next, the used developer cartridge 328 is removed from the processing cartridge 317 and a new developer cartridge 328 filled with toner is mounted on the processing cartridge 317 according to a method described later. Finally, the processing cartridge 317 is mounted in the main case 302.

The developer cartridge 328 includes a casing 351 that is detachably mounted on the drum cartridge 326 and, within the casing 351, a developer roller 331, a thickness regulating blade 332, and a supply roller 333.

Figure 21:
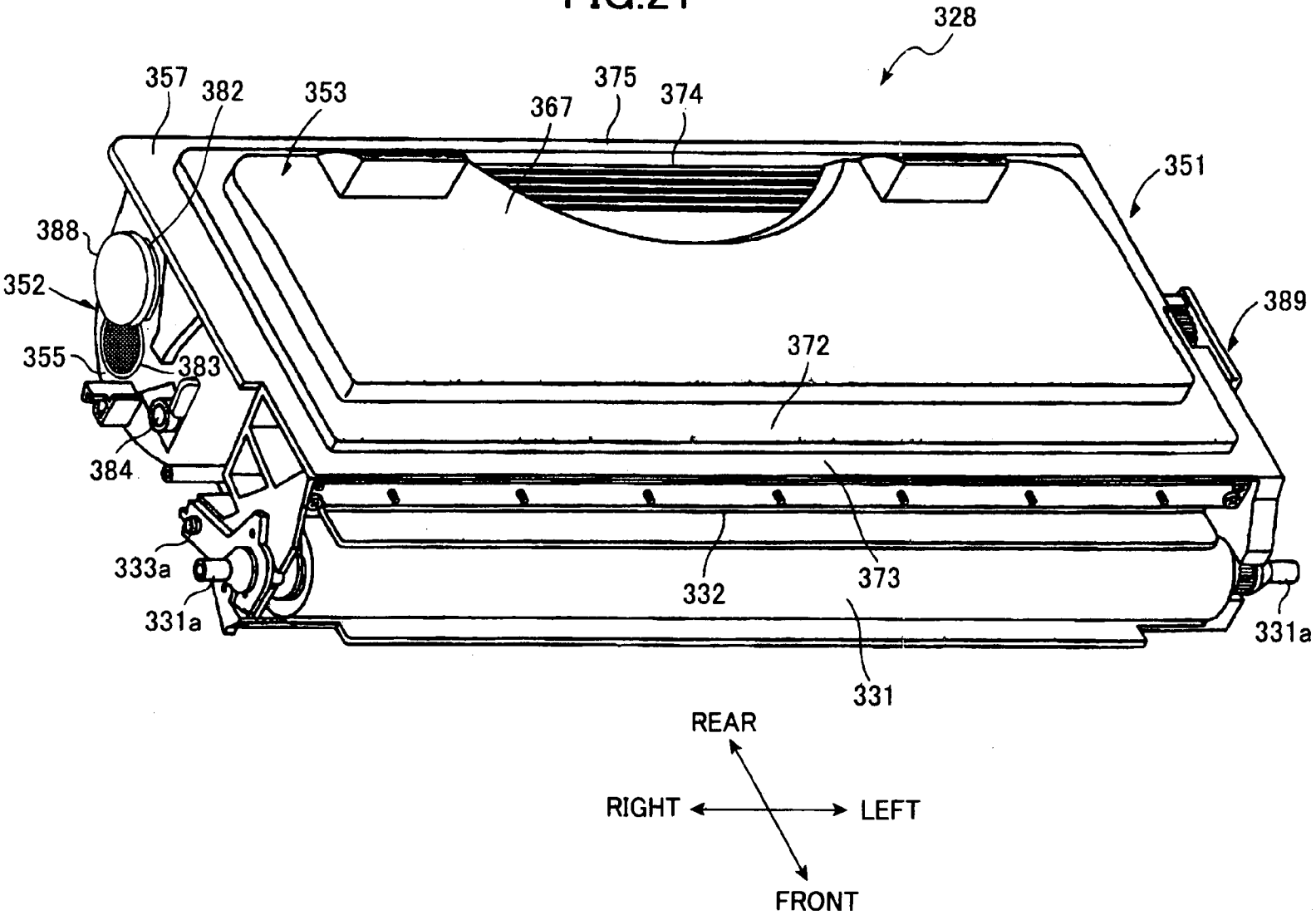
FIG. 21 is a perspective view showing a developer cartridge according to the third embodiment.

The casing 351 of the developer cartridge 328 is formed in a substantially rectangular box shape when viewed in a plan view and is elongated in the left-right direction (hereinafter denoted as the left-right direction), which is the direction orthogonal to the conveying direction of the paper 3, as shown in FIG. 21. As shown in FIGS. 20 and 21, the casing 351 includes a cartridge frame section 352 and a top cover section 353.

The cartridge frame section 352 is integrally formed of a left side wall 354, a right side wall 355, a back wall 356, a top wall 357, and a bottom wall 358, thereby forming a box shape with an open front side. A top wall opening 359 having a substantially rectangular shape from a plan view is formed in the top wall 357.

As shown in FIG. 20, an upper partitioning plate 360 extending downward is formed along the left-right direction in a front side edge part of the top wall opening 359. A frame-side front sponge member 361 is affixed to a back surface of the upper partitioning plate 360 along the left-right direction. A frame-side rear sponge member 362 is affixed to a front surface of the back wall 356 along the left-right direction in confrontation with the frame-side front sponge member 361.

Frame-side side sponge members 387 (see FIG. 24) are affixed to inner side surfaces of the left side wall 354 and right side wall 355 so as to contact the frame-side front sponge member 361 and the frame-side rear sponge member 362. The frame-side front sponge member 361, the frame-side rear sponge member 362, and the frame-side side sponge members 387 are formed of a urethane sponge or the like.

The bottom wall 358 is integrally formed of an arcuate curved wall 363 extending from the back wall 356, and a support wall 364 extending from the curved wall 363 and extending toward the front. A lower partitioning wall 365 protruding upward is formed between the curved wall 363 and support wall 364 along the left-right direction. The upper partitioning plate 360 and lower partitioning wall 365 are separated a predetermined distance from each other. The area between the upper partitioning plate 360 and the lower partitioning wall 365 is a toner supply through-hole 366.

As shown in FIGS. 20 and 21, the top cover section 353 is integrally formed of a top plate 367 covering the top wall opening 359, a front plate 368 extending downward from the inner side near the front edge of the top plate 367, and a back plate 369 extending downward from the inner side near the back edge of the top plate 367. The front plate 368 and back plate 369 confront each other, both extending along the left-right direction. The top cover section 353 is also integrally provided with left and right side plates 386 extending downward from the inner sides on the left and right side edges of the top plate 367. The left and right side plates 386 are formed integrally with the front plate 368 and back plate 369.

A cover-side front sponge member 370 is affixed to a front surface of the front plate 368 along the left-right direction. A cover-side rear sponge member 371 is affixed to a back surface of the back plate 369 along the left-right direction. Cover-side side sponge members (not shown) are fixed to outer side surfaces of the left and right side plates 386 so as to contact the cover-side front sponge member 370 and cover-side rear sponge member 371. The cover-side front sponge member 370, the cover-side rear sponge member 371, and the cover-side side sponge members are formed of a urethane sponge or the like.

The top cover section 353 fits into the top wall opening 359 of the cartridge frame section 352 from a direction substantially orthogonal to the lengthwise direction of the developer cartridge 328, such that the cover-side front sponge member 370 of the front plate 368 is in sliding opposition to the frame-side front sponge member 361 on the upper partitioning plate 360; the cover-side rear sponge member 371 on the back plate 369 is in sliding opposition to the frame-side rear sponge member 362 on the back wall 356; the cover-side side sponge member of the left side plate 386 is in sliding opposition to the frame-side side sponge members 387 of the left side wall 354; and the cover-side side sponge member on the right side plate 386 is in sliding opposition to the frame-side side sponge members 387 on the right side wall 355.

The bottom surface of a front end 372 of the top plate 367 extending from the front edge of the top plate 367 to the point at which the front plate 368 is provided is joined by ultrasonic welding to the top surface of a front end 373 on the top wall 357. The bottom surface of a back end 374 of the top plate 367 extending from the back edge of the top plate 367 to the point at which the back plate 369 is provided is joined by ultrasonic welding to the top surface of a back end 375 on the back wall 356.

Similarly, the bottom surface of a left end of the top plate 367 extending from the left edge of the top plate 367 to the point at which the left side plate 386 is provided is joined by ultrasonic welding to the top surface on the left side wall 354. The bottom surface of a right end of the top plate 367 extending from the right edge of the top plate 367 to the point at which the right side plate 386 is provided is joined by ultrasonic welding to the top surface on the right side wall 355.

With this construction, the top wall opening 359 of the cartridge frame section 352 is covered by the top plate 367 of the top cover section 353. The cover-side front sponge member 370 and frame-side front sponge member 361 contact pressingly each other with pressure, forming a tight bond between the opposing surfaces. The cover-side rear sponge member 371 and frame-side rear sponge member 362 also contact pressingly each other with pressure, forming a tight bond between the opposing surfaces. Similarly, the left and right cover-side side sponge members pressingly contact the left and right frame-side side sponge members 387 with pressure, forming a tight bond between the respective opposing surfaces. In this state, the top cover section 353 is attached to the cartridge frame section 352.

The casing 351 assembled in this way is divided into a back area and a front area by the upper partitioning plate 360 and the lower partitioning wall 365. The back area is a toner accommodating chamber 376 for accommodating toner, while the front area is a developing chamber 377 accommodating the developer roller 331, thickness regulating blade 332, and supply roller 333.

An agitator 378 is disposed in the toner accommodating chamber 376. The agitator 378 includes a rotating shaft 379 rotatably provided along the left-right direction, that is, the lengthwise direction of the toner accommodating chamber 376 in the center of the toner accommodating chamber 376 when viewed from the side; a stirring member 380 formed integrally along the left-right range of the rotating shaft 379 and extending diametrically therefrom; and a scraping member 381 formed of a flexible film provided along the left-right direction on the free end of the stirring member 380.

Figure 22:
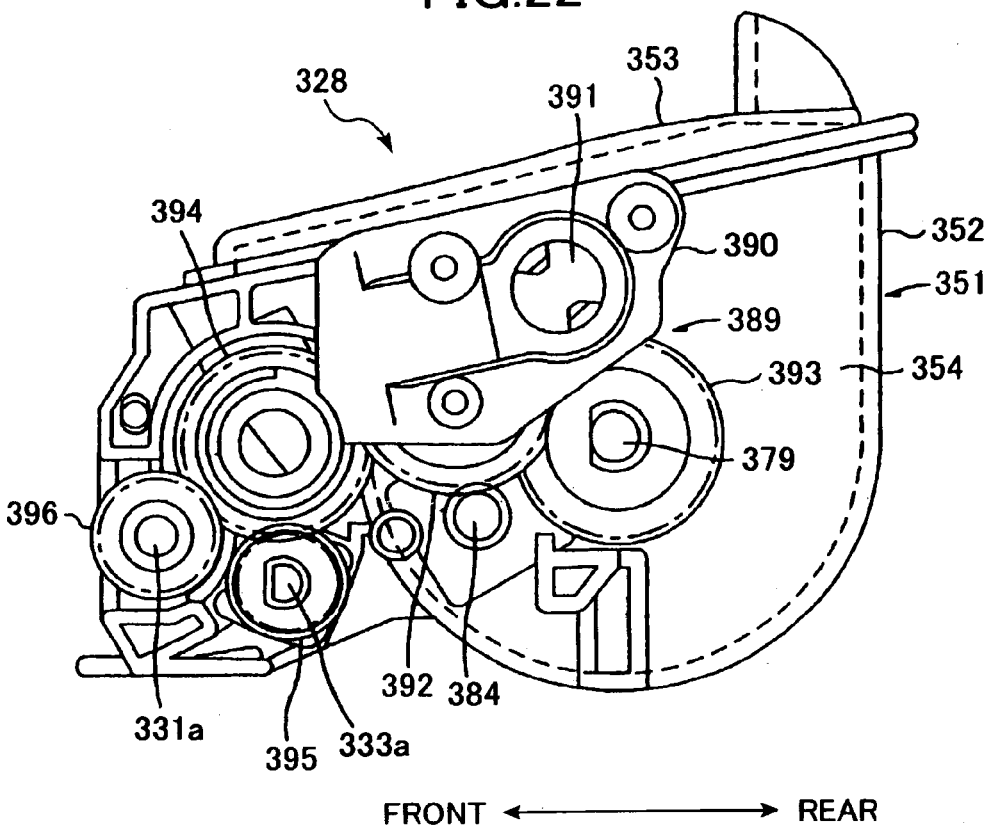
FIG. 22 is a left side view showing the developer cartridge of FIG. 21.
Figure 23:
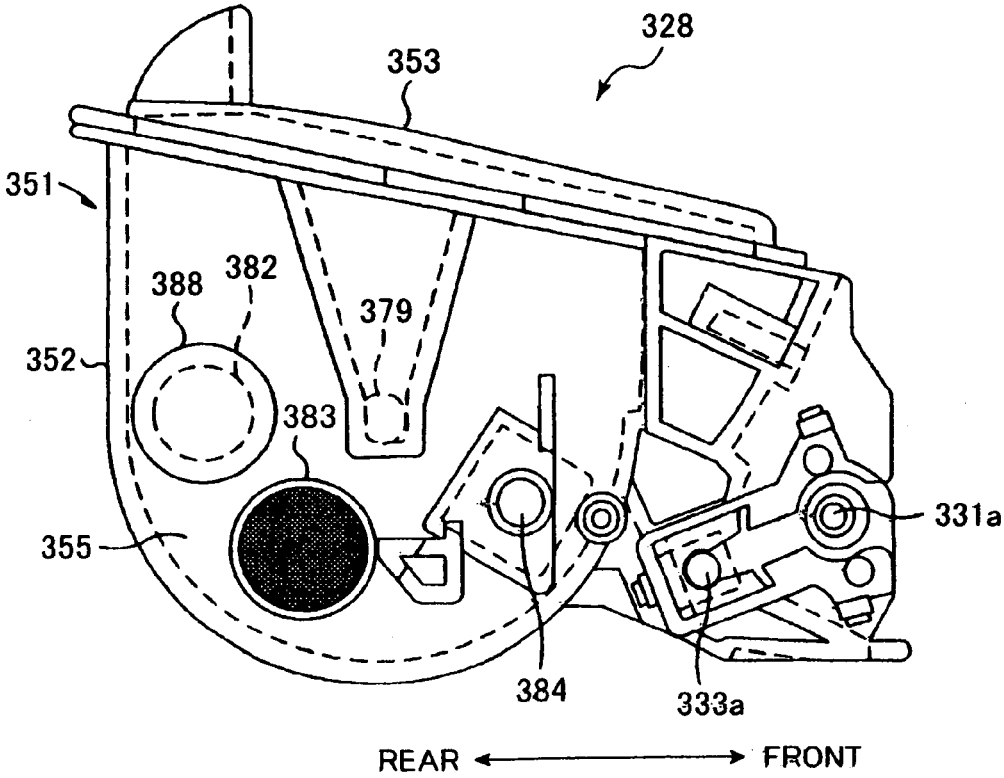
FIG. 23 is a right side view showing the developer cartridge of FIG. 21.

As shown in FIGS. 22 and 23, the rotating shaft 379 is rotatably supported in the left side wall 354 and the right side wall 355 of the casing 351 and is driven to rotate by a motive force inputted to an agitator driving gear 393 (see FIG. 22) described later. When the rotating shaft 379 is driven to rotate, the stirring member 380 integrally provided on the rotating shaft 379 along the axial direction of the same rotates around the rotating shaft 379. The scraping member 381 bends flexibly while scraping the top surface of the arcuate curved wall 363, thereby uniformly stirring toner accommodated in the toner accommodating chamber 376 while scraping up and discharging toner toward the developing chamber 377 through the toner supply through-hole 366.

As shown in FIGS. 22 and 23, remaining toner detection windows 384 are provided near the lower front side of the toner accommodating chamber 376 in the left side wall 354 and right side wall 355 respectively, opposing each other in the left-right direction.

As shown in FIG. 20, a cleaning member 385 is integrally provided on the agitator 378 for cleaning the remaining toner detection windows 384. The cleaning member 385 is disposed at a position on the periphery of the rotating shaft 379 and displaced 180 degrees from the stirring member 380 for wiping each of the remaining toner detection windows 384 as the agitator 378 rotates.

As shown in FIGS. 20 and 23, a toner injecting through-hole 382 and a filter member 383 are provided in the right side wall 355.

The toner injecting through-hole 382 is formed by boring a substantially circular through-hole through the toner accommodating chamber 376 in the back center of the right side wall 355 along the thickness direction of the right side wall 355. After toner is introduced using a filling method described later, a cap member 388 is mounted in the toner injecting through-hole 382 to cover the same.

The filter member 383 is formed in a thick disc shape from a glass filter, for example, and allows the passage of air but prevents the passage of toner. The filter member 383 is embedded in the right side wall 355 at approximately the lower center position in a substantially circular through-hole bored in the thickness direction of the right side wall 355.

The supply roller 333 is disposed in the back of the developing chamber 377 below the upper partitioning plate 360, and the axis of the supply roller 333 extends in the lengthwise direction of the casing 351. The supply roller 333 includes a metal roller shaft 333*a* covered by a roller 333*b* formed of a conductive sponge material. As shown in FIGS. 22 and 23, the metal roller shaft 333*a* is rotatably supported in the left side wall 354 and right side wall 355 of the casing 351. The metal roller shaft 333*a* is driven to rotate in the direction indicated by the arrow in FIG. 20 (the counterclockwise direction) by a motive force inputted to a supply roller driving gear 395 (see FIG. 22) described later.

As shown in FIG. 20, the developer roller 331 is disposed in the developing chamber 377 in front of the supply roller 333. The developer roller 331 and the supply roller 333 contact pressingly with each other. The axis of the developer roller 331 extends in the lengthwise direction of the casing 351. The developer roller 331 includes a metal roller shaft 331*a* covered by a roller 331*b* formed of a conductive rubber material. More specifically, the roller 331*b* of the developer roller 331 is formed of an electrically conductive urethane rubber or silicon rubber including fine carbon particles, the surface of which is coated with a urethane rubber or silicon rubber including fluorine. As shown in FIGS. 22 and 23, the metal roller shaft 331*a* of the developer roller 331 is rotatably supported in the left side wall 354 and right side wall 355 of the casing 351 and is driven to rotate in the direction of the arrow in FIG. 20 (counterclockwise) by a motive force inputted to a developing roller driving gear 396 (see FIG. 22) described later. A developing bias is also applied to the developer roller 331.

The thickness regulating blade 332 is disposed in the developing chamber 377 above the developer roller 331, the length of which extends along the length of the casing 351. The thickness regulating blade 332 includes a blade body 332*a* formed of a metal leaf spring and a pressing member 332*b* formed of an insulating silicon rubber and having a circular cross-sectional shape disposed on the end of the blade body 332*a*. One end of the blade body 332*a* is supported on the top wall 357. The pressing member 332*b* provided on the other end of the blade body 332*a* contacts the developer roller 331 by the urging force of the blade body 332*a*. With this construction, the back surface of the thickness regulating blade 332 (the surface on the opposite side of the surface contacting the developer roller 331) faces toward the toner accommodating chamber 376.

A lower film 335 is disposed along the axial direction of the developer roller 331 between the developer roller 331 and the bottom wall 358. The lower film 335 is formed of a polyethylene teraphthalate film, for example. The front end of the lower film 335 is fixed to the bottom wall 358, while the back end contacts the surface of the developer roller 331. With this construction, the back surface of the lower film 335 (the surface on the opposite side of the surface contacting the developer roller 331) faces toward the toner accommodating chamber 376.

As shown in FIG. 22, the left side wall 354 of the casing 351 is provided with a gear train 389 for driving the agitator 378, supply roller 333, and developer roller 331 to rotate. The gear train 389 includes a holder plate 390 supported on the left side wall 354; an input gear 391 supported in the holder plate 390; a first intermediate gear 392 disposed in the lower front direction of the input gear 391 and engaged therewith; the agitator driving gear 393 disposed in the rearward direction of the first intermediate gear 392 and engaged therewith and coupled with the rotating shaft 379 of the agitator 378; a second intermediate gear 394 disposed in the front of the first intermediate gear 392 and engaged therewith; the supply roller driving gear 395 disposed below the second intermediate gear 394 and engaged therewith and coupled with the metal roller shaft 333*a* of the supply roller 333; and the developing roller driving gear 396 disposed in the front of the second intermediate gear 394 and engaged therewith and coupled with the metal roller shaft 331*a* of the developer roller 331.

With the developer cartridge 328 mounted on the drum cartridge 326, the entire assembly is mounted in the main case 302. When a motive force is inputted to the input gear 391 from a motor not shown in the drawings and provided in the main case 302, each of the agitator driving gear 393, supply roller driving gear 395, and developing roller driving gear 396 are driven to rotate by the motive force transferred from the input gear 391 via the first intermediate gear 392 and second intermediate gear 394. As a result, the agitator 378, supply roller 333, and developer roller 331 are rotated.

As shown in FIG. 20, the conductive brush 334 is positioned downstream from the transfer roller 330 in the rotating direction of the photosensitive drum 327 and upstream from the charging device 329 and is disposed in contact with the surface of the photosensitive drum 327. The conductive brush 334 removes paper dust deposited on the surface of the photosensitive drum 327, after the transfer operation.

The laser printer 301 is also provided with a reverse conveying unit 347 for enabling images to be formed on both sides of the paper 3. The reverse conveying unit 347 includes discharge rollers 345, a reverse conveying path 348, a flapper 349, and a plurality of reverse conveying rollers 350.

The pair of discharge rollers 345 can be switched between a forward rotation and a reverse rotation. As described above, the discharge rollers 345 rotates in the forward direction when discharging the paper 3 onto the discharge tray 346, but the discharge rollers 345 also rotates in a reverse direction to reverse the conveying direction of the paper 3.

The reverse conveying path 348 is disposed in a vertical direction in order to convey the paper 3 from the discharge rollers 345 to the plurality of reverse conveying rollers 350 disposed below the image forming unit 305. The upstream end of the reverse conveying path 348 is disposed near the discharge rollers 345, while the downstream end is disposed near the reverse conveying rollers 350.

The flapper 349 is pivotably provided in order to be switched between branches leading toward the paper discharge path 344 and the reverse conveying path 348. By toggling the excitation of a solenoid (not shown) on and off, the conveying direction of the paper 3 reversed by the discharge rollers 345 can be switched from the direction toward the paper discharge path 344 to the direction toward the reverse conveying path 348.

The reverse conveying rollers 350 are disposed in a substantially horizontal direction above the feed tray 306. The reverse conveying roller 350 farthest upstream is positioned near the downstream end of the reverse conveying path 348. The reverse conveying roller 350 farthest downstream is positioned below the register rollers 312.

When forming images on both sides of the paper 3, the reverse conveying unit 347 is operated as follows. After having an image formed on one surface, the paper 3 is conveyed by the conveying rollers 343 to the discharge rollers 345 via the paper discharge path 344. With the paper 3 interposed between the discharge rollers 345, the discharge rollers 345 rotate in a forward rotation, conveying the paper 3 temporarily outward (toward the discharge tray 346), such that a large part of the paper 3 is fed out of the device. When the trailing edge of the paper 3 becomes interposed between the discharge rollers 345, the discharge rollers 345 halt their forward rotation.

Next, the discharge rollers 345 rotate in the reverse direction, while the flapper 349 switches the conveying direction to convey the paper 3 toward the reverse conveying path 348. Hence, the paper 3 is conveyed toward the reverse conveying path 348 leading now with the trailing edge. After the paper 3 is conveyed into the reverse conveying path 348, the flapper 349 is switched to its original state, that is, the position for conveying the paper 3 supplied from the conveying rollers 343 toward the discharge rollers 345.

Next, the paper 3 conveyed along the reverse conveying path 348 in the reverse direction is conveyed to the reverse conveying rollers 350, which in turn convey the paper 3 upward to the register rollers 312. After being conveyed to the register rollers 312, the paper 3 is adjusted to a proper register and conveyed toward the transfer position with its front and back surfaces switched, enabling images to be formed on both sides of the, paper 3.

Next, a method for filling the toner accommodating chamber 376 of the developer cartridge 328 with toner will be described. This toner filling process is generally applied during the manufacturing stage of the developer cartridge 328, but can also be applied to a used developer cartridge 328 for refilling the same with toner.

Figure 24:
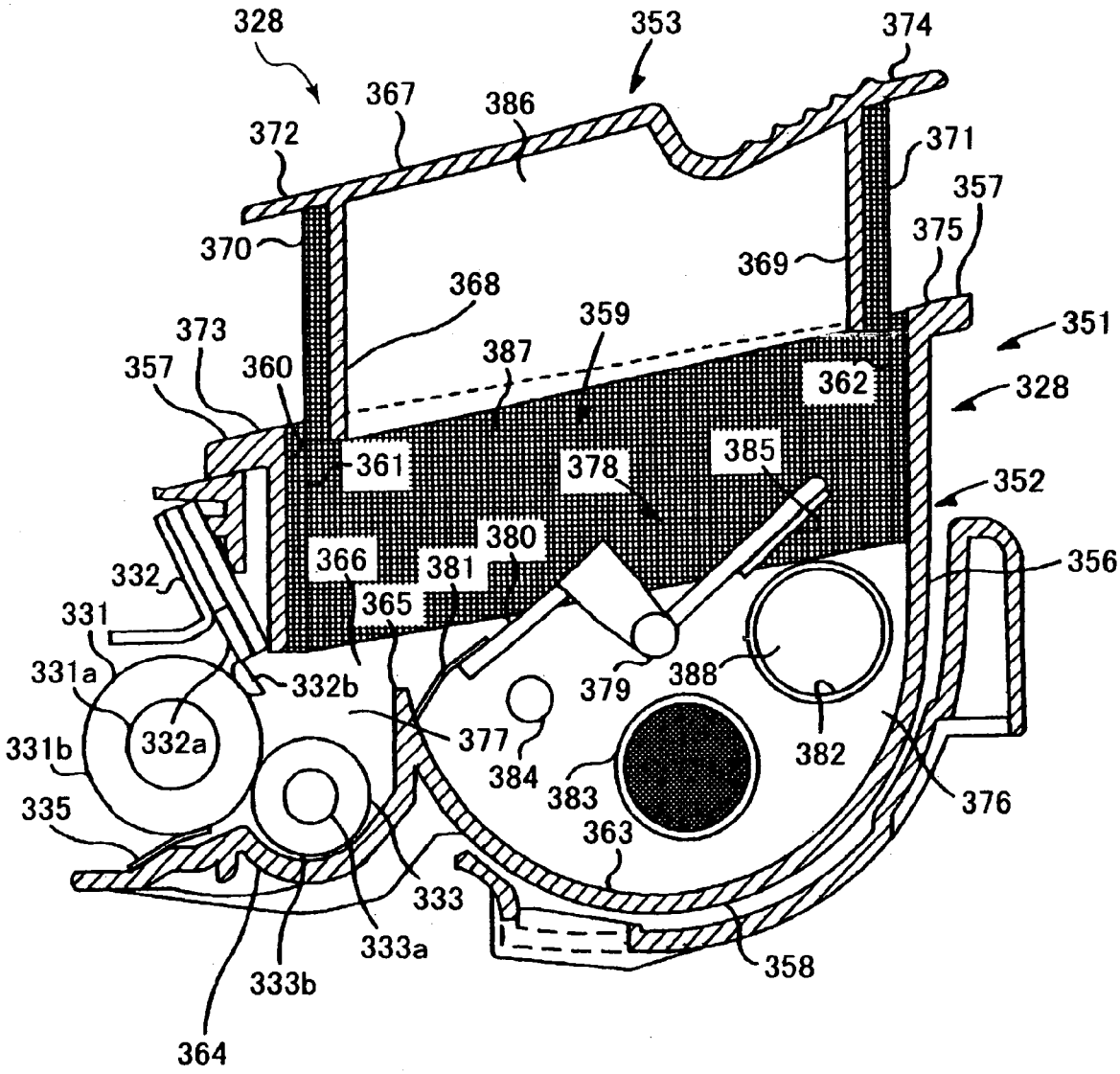
FIG. 24 is a side cross-sectional view showing the developer cartridge before the top cover section is compressed.

When filling the toner accommodating chamber 376 with toner, the top cover section 353 is separated from the cartridge frame section 352, as shown in FIG. 24, such that the free ends of the front plate 368, the back plate 369, and the left and right side plates 386 on the top cover section 353 are slidingly fitted into the top ends of the upper partitioning plate 360, back wall 356, left side wall 354, and right side wall 355 of the cartridge frame section 352. Further, the frame-side front sponge member 361 contacts the cover-side front sponge member 370, the frame-side rear sponge member 362 contacts the cover-side rear sponge member 371, and the left and right frame-side side sponge members 387 contact the left and right cover-side side sponge members.

In this state, toner is reliably prevented from leaking between the opposing surfaces of the frame-side front sponge member 361 and cover-side front sponge member 370, the opposing surfaces of the frame-side rear sponge member 362 and the cover-side rear sponge member 371, and the opposing surfaces of the left and right frame-side side sponge members 387 and the left and right cover-side side sponge members. By pressing the top cover section 353 toward the cartridge frame section 352 at this time, the top cover section 353 can be compressed in relation to the cartridge frame section 352.

Figure 25:
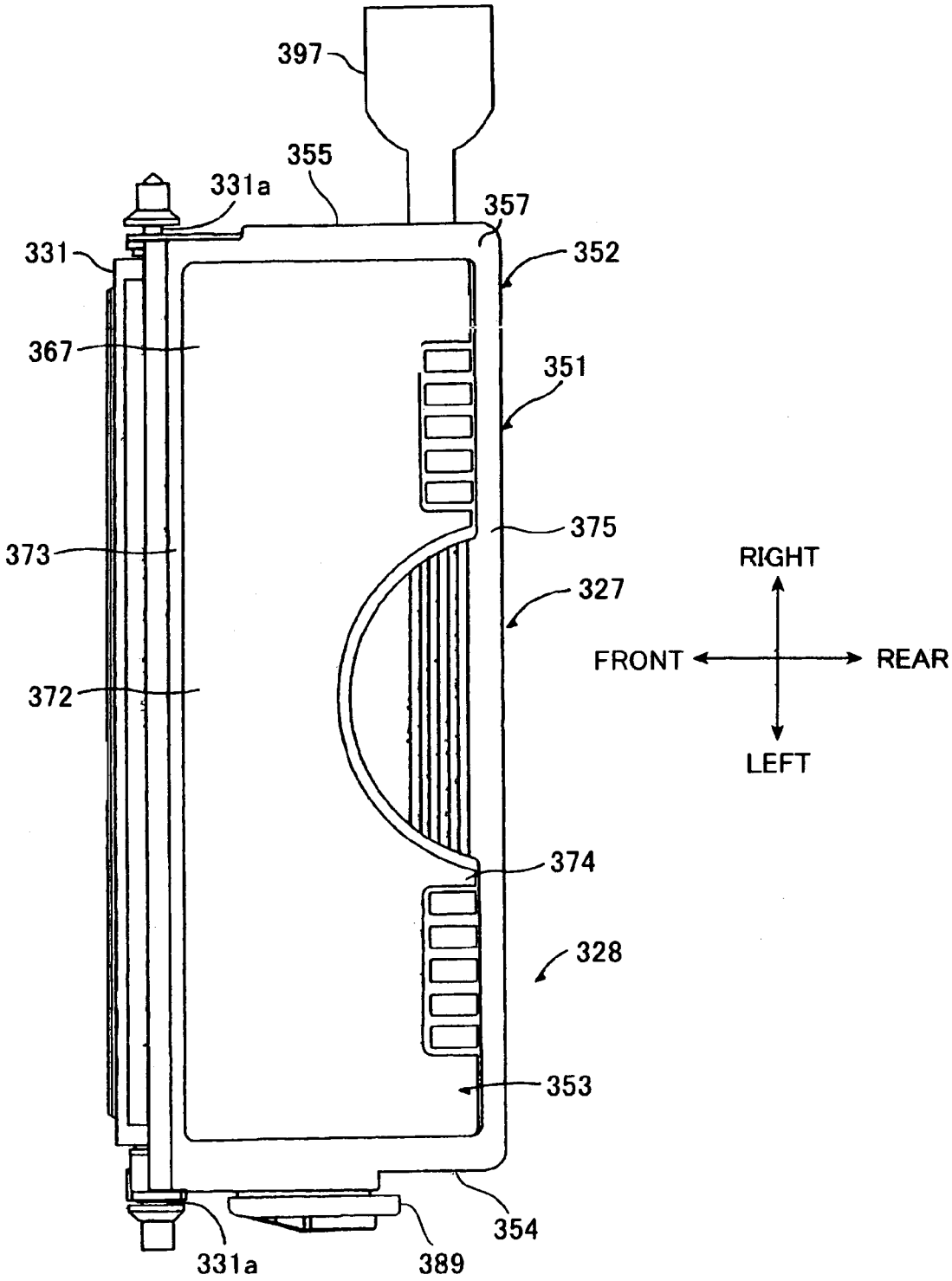
FIG. 25 is a side view showing the developer cartridge during a toner filling process according to the third embodiment.

In the above-mentioned condition, the developer cartridge 328 is stood on end, such that its lengthwise direction is aligned vertically, with the right side wall 355 on the top facing upward and the left side wall 354 on the bottom facing downward, as shown in FIG. 25. The tip of a hopper 397 is inserted into the toner injecting through-hole 382, and the developer cartridge 328 is filled with toner via the hopper 397.

Here, the toner injecting through-hole 382 is provided such that the direction for introducing toner follows the lengthwise direction of the toner accommodating chamber 376 and a sufficient length is secured for introducing the toner. Therefore, toner introduced through the hopper 397 can be effectively introduced into the toner accommodating chamber 376 in the developer cartridge 328 as the toner falls along the length of the toner accommodating chamber 376.

Figure 26:
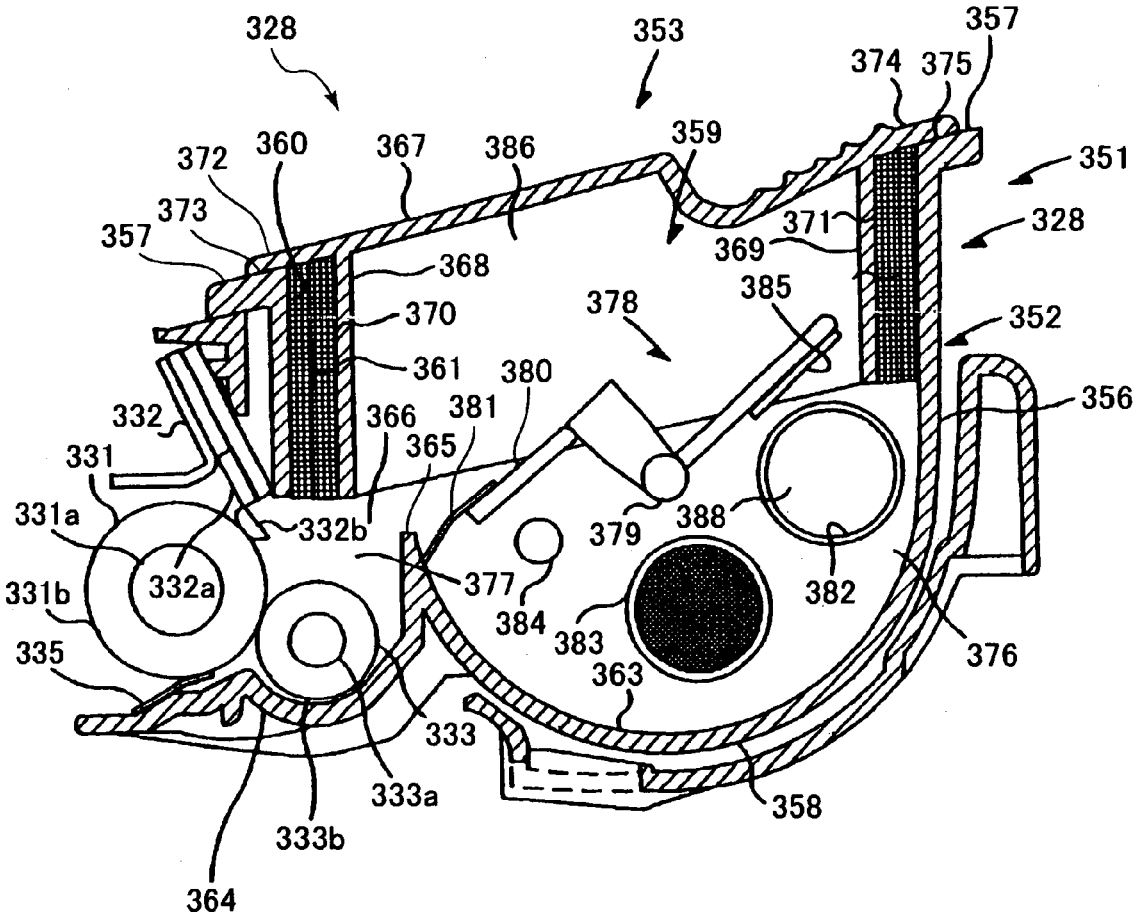
FIG. 26 is a side cross-sectional view showing the developer cartridge after the top cover section is compressed.

When the toner reaches a predetermined amount (for example, 1.5–2 times the apparent loose density of the toner), the hopper 397 is removed and the toner injecting through-hole 382 is sealed with the cap member 388. Then, as shown in FIG. 26, the orientation of the developer cartridge 328 is changed such that the top cover section 353 of the casing 351 faces upward along the gravitational direction while the toner injecting through-hole 382 faces horizontally and the axial direction of the agitator 378 is aligned horizontally.

Subsequently, the top cover section 353 is pressed toward the cartridge frame section 352 until the front end 372 of the top plate 367 contacts the front end 373, the back end 374 of the top plate 367 contacts the back end 375, and the left and right ends of the top plate 367 contact the top surface of the left side wall 354 and right side wall 355. In this way, the top cover section 353 and the cartridge frame section 352 are compressed together.

Since the toner accommodating chamber 376 is compressed in a direction substantially orthogonal to the lengthwise direction of the toner accommodating chamber 376, a large capacity (for example, 0.7–1.0 times the volume of toner at the apparent loose density) can be compressed by moving the toner accommodating chamber 376 a short compressing distance X (see FIG. 20). Therefore, efficiency of the filling operation can be improved.

When compressing the toner accommodating chamber 376, air in the toner accommodating chamber 376 pressurized by the compressing operation can escape through the filter member 383, thereby ensuring a smooth compressing operation.

Further, by providing the toner injecting through-hole 382 and filter member 383 on the opposite side from the gear train 389. The gears in the gear train 389 can be protected from contamination by toner that might accidentally escape via the toner injecting through-hole 382 or filter member 383.

During this compressing operation, the top wall 357 of the top cover section 353, and not the right side wall 355 in which the toner injecting through-hole 382 is formed, is compressed. Hence, the toner accommodating chamber 376 can be reliably compressed from a direction different from the toner filling direction, thereby further improving the efficiency of the filling operation.

The agitator 378, supply roller 333, developer roller 331, and thickness regulating blade 332 are disposed along the lengthwise direction of the casing 351 in the developer cartridge 328. Hence, the agitator 378, the supply roller 333, developer roller 331, and thickness regulating blade 332 do not interfere in the compressing operation, even when the top cover section 353 is compressed in relation to the cartridge frame section 352 from a direction orthogonal to the lengthwise direction of the casing 351, thereby achieving a smooth filling operation.

Even though a filling pressure from toner is added to the lower film 335 and the thickness regulating blade 332 during the compressing operation, this filling pressure is applied from the back surfaces of the lower film 335 and thickness regulating blade 332 (the surfaces opposite the surfaces contacting the developer roller 331). Accordingly, this filling pressure has the effect of pressing the lower film 335 and thickness regulating blade 332 against the developer roller 331, thereby reliably preventing toner from leaking past the developer roller 331 during the filling operation.

Further, the top cover section 353, which is the top side in the gravitational direction when the developer cartridge 328 is in a mounted state, is compressed during the compressing operation and not the bottom wall 358, which is the bottom side of the developer cartridge 328 in the gravitational direction. Accordingly, the relative positions of the bottom wall 358 and agitator 378 do not change during the filling and compressing operation. By accurately fixing the relative positions of the bottom wall 35B and agitator 378 in this way, it is possible to ensure that the scraping member 381 of the agitator 378 can reliably scrape toner accumulating on the bottom wall 358 in the toner accommodating chamber 376.

The toner filling operation is completed after compression by fixing the front end 372 of the top plate 367 to the front end 373, the back end 374 of the top plate 367 to the back end 375, and the left and right ends of the top plate 367 to the left side wall 354 and right side wall 355 by ultrasonic welding.

By fixing the casing 351 in a compressed state after compressing the casing 351 in this way, the filled state of the efficiently introduced toner can be maintained.

When compressing the developer cartridge 328, the casing 351 defining the toner accommodating chamber 376 is compressed while sliding the opposing surfaces of the frame-side front sponge member 361 and cover-side front sponge member 370, the frame-side rear sponge member 362 and cover-side rear sponge member 371, and the left and right frame-side side sponge members 387 and left and right cover-side side sponge members in close contact with each other. After this compression, the sliding parts of the frame-side front sponge member 361 and cover-side front sponge member 370, the frame-side rear sponge member 362 and cover-side rear sponge member 371, and the left and right frame-side side sponge members 387 and left and right cover-side side sponge members maintain close contact with each other, thereby reliably preventing developer from leaking out of the sliding areas during and after the toner filling process.

In conventional devices, such as that described in Japanese patent application publication No. HEI-5-232810, for example, the contracting cylinder is expanded and contracted like a bellows. Accordingly, toner can sometimes clog the cylinder, making it impossible to compress the same. However, by configuring the sliding parts of the frame-side front sponge member 361 and cover-side front sponge member 370, the frame-side rear sponge member 362 and cover-side rear sponge member 371, and the left and right frame-side side sponge members 387 and the left and right cover-side side sponge members, the casing 351 can be properly compressed while preventing toner from becoming clogged between the sliding parts.

By introducing toner in this way, the toner accommodating chamber 376 can be filled with toner of a density equal to or greater than the apparent loose density, thereby achieving an efficient filling operation.

Toner introduced in this filling operation is a polymerized toner having a substantially spherical particle shape. Hence, the toner can be introduced densely due to its good fluidity, thereby achieving an efficient filling operation.

When introducing toner according to this filling method, first toner is introduced into the developer cartridge 328 through the toner injecting through-hole 382. Subsequently, the toner accommodating chamber 376 can be contracted by compressing the casing 351 of the developer cartridge 328 from a direction different than the filling direction. Hence, the toner accommodating chamber 376 can be compressed along a short compressing distance, while maintaining a sufficient length of the toner accommodating chamber 376 in the direction in which toner is introduced. Therefore, the efficiency of the toner filling operation can be improved with a simple construction, while it is possible to reduce the size of the toner accommodating chamber 376, as well as the developer cartridge 328 and processing cartridge 317, and even the laser printer 301, and to fill the developer cartridge 328 with toner at a high density.

Modifications of the third embodiment will be described below.

In the above-described third embodiment, the present embodiment relates to a developer cartridge 328. However, the present embodiment can be applied to a vessel for accommodating toner such as the toner cartridge 60 shown in FIG. 12.

Also, in the third embodiment, the casing 351 of the toner accommodating chamber 376 is compressed in a direction substantially orthogonal to the lengthwise direction of the toner accommodating chamber 376. However, this direction need not be orthogonal to the lengthwise direction, but can be a direction with an angle.

While the invention has been described in detail with reference to the specific embodiments thereof, it would be apparent to those skilled in the art that various changes and modifications may be made therein without departing from the spirit of the invention.

What is claimed is:

1. A developer accommodating vessel comprising:

a casing, the casing having a first casing section and a second casing section, the first and second casing sections defining a developer accommodating chamber that accommodates the developer therein, the first and second casing sections being made of a rigid material;

a developer supply through-hole formed in the casing for filling the casing with developer, the first and second casing sections being movable relative to one another, allowing the developer to be compressed in a direction different from a filling direction in which developer is introduced through the developer supply through-hole; and the developer being a powdered developer.

2. A developer accommodating vessel as claimed in claim 1, wherein the casing is capable of being compressed to reduce a width defined along a direction different from the filling direction while maintaining fixed a length defined along the filling direction, thereby reducing the volume of the casing.

3. A developer accommodating vessel as claimed in claim 1, wherein the casing is capable of being compressed to reduce a width defined along a direction substantially orthogonal to the filling direction while maintaining fixed a length defined along the filling direction.

4. A developer accommodating vessel as claimed in claim 1, wherein the developer supply through-hole is formed in the casing such that the filling direction for introducing developer is aligned with a lengthwise direction of the casing.

5. A developer accommodating vessel as claimed in claim 1, wherein the casing is capable of being compressed in a direction substantially orthogonal to a lengthwise direction of the casing.

6. A developer accommodating vessel as claimed in claim 1, wherein the casing is capable of being fixed in its compressed state with its volume being maintained fixed.

7. A developer accommodating vessel as claimed in claim 1, further comprising an agitating member provided inside the casing for agitating the developer, wherein the agitating member is disposed such that an axial direction of the agitating member is aligned with a lengthwise direction of the casing.

8. A developer accommodating vessel as claimed in claim 7, wherein the casing has a top portion facing upward along the gravitational direction while the developer supply through-hole faces horizontally and the axial direction of the agitating member is aligned horizontally, the top portion being movable to compress the casing to reduce the volume thereof.

9. A developer accommodating vessel as claimed in claim 1, further comprising a filter provided on the casing for allowing the passage of air while preventing the passage of developer.

10. A developer accommodating vessel as claimed in claim 1, wherein the developer is a toner having substantially spherically shaped particles.

11. A developer accommodating vessel as claimed in claim 1, wherein the developer is filled in the casing at a density equal to or higher than an apparent loose density when the casing is in a compressed state.

12. A developer accommodating vessel as claimed in claim 1, wherein the casing includes a first casing section having a first sponge member and a second casing section having a second sponge member, the first and second casing sections being movable relatively with each other with the first and second sponge members sliding against each other.

13. A developer cartridge comprising:

a developer accommodating vessel including:

a casing, the casing having a first casing section and a second casing section, the first and second casing sections defining a developer accommodating chamber that accommodates the developer therein, the first and second casing sections being made of a rigid material;

a developer supply through-hole formed in the casing for filling the casing with developer, the first and second casing sections being movable relative to one another, allowing the developer to be compressed in a direction different from a filling direction in which developer is introduced through the developer supply through-hole; and a developer carrying member for receiving the developer supplied from the casing; wherein the developer is a powdered developer.

14. A developer cartridge as claimed in claim 13, wherein the casing includes:

a wall formed with the developer supply through-hole; and another wall moved to compress the casing.

15. A developer cartridge as claimed in claim 13, wherein the developer carrying member is disposed such that an axis of the developer carrying member is aligned with a lengthwise direction of the casing.

16. A developer cartridge as claimed in claim 13, further comprising a developer leakage preventing member contacting the developer carrying member for preventing developer from leaking out of the developer cartridge, wherein the developer leakage preventing member is pressed against the developer carrying member by a pressure of the developer when the developer is introduced into the casing through the developer supply through-hole.

17. A developer cartridge as claimed in claim 13, further comprising a blade provided in contact with the developer carrying member for forming a thin layer of developer on the developer carrying member, wherein the blade is pressed against the developer carrying member by a pressure of the developer when the developer is introduced into the casing through the developer supply through-hole.

18. A developer cartridge as claimed in claim 13, wherein the developer is filled in the casing at a density equal to or higher than an apparent loose density when the casing is in a compressed state.

19. A developer cartridge as claimed in claim 13, wherein the casing includes:

a first casing section having a first sponge member and defining an accommodating chamber accommodating the developer; and a second casing section having a second sponge member, the second casing section moving in contact with the first casing section with opposing surfaces of the first sponge member and the second sponge member sliding against each other.

20. A developer cartridge as claimed in claim 13, wherein the developer accommodating vessel further includes a filter provided on the casing for allowing the passage of air while preventing the passage of developer.

21. A processing device comprising:

a developer cartridge including:

a developer accommodating vessel having:

a casing, the casing having a first casing section and a second casing section, the first and second casing sections defining a developer accommodating chamber that accommodates the developer therein, the first and second casing sections being made of a rigid material;

a developer supply through-hole formed in the casing for filling the casing with developer, the first and second casing sections being movable relative to one another, allowing the developer to be compressed in a direction different from a filling direction in which developer is introduced through the developer supply through-hole; and a developer carrying member for receiving the developer supplied from the casing; and an electrostatic latent image bearing member for forming an electrostatic latent image thereon and for receiving the developer from the developer carrying member; wherein the developer is a powdered developer.

22. A processing device as claimed in claim 21, wherein the developer is filled in the casing at a density equal to or higher than an apparent loose density when the casing is in a compressed state.

23. A processing device as claimed in claim 21, wherein the casing includes:

a first casing section having a first sponge member and defining an accommodating chamber accommodating the developer; and a second casing section having a second sponge member, the second casing section moving in contact with the first casing section with opposing surfaces of the first sponge member and the second sponge member sliding against each other.

24. A processing device as claimed in claim 21, wherein the developer accommodating vessel further includes a filter provided on the casing for allowing the passage of air while preventing the passage of developer.

25. An image forming device comprising:

a developer cartridge including:

a developer accommodating vessel having:

a casing, the casing having a first casing section and a second casing section, the first and second casing sections defining a developer accommodating chamber that accommodates the developer therein, the first and second casing sections being made of a rigid material; and a developer supply through-hole formed in the casing for filling the casing with developer, the first and second casing sections being movable relative to one another, allowing the developer to be compressed in a direction different from a filling direction in which developer is introduced through the developer supply through-hole; and a developer carrying member for receiving the developer supplied from the casing; and an electrostatic latent image bearing member for forming an electrostatic latent image thereon and for receiving the developer from the developer carrying member; wherein the developer is a powdered developer.

26. An image forming device as claimed in claim 25, wherein the developer is filled in the casing at a density equal to or higher than an apparent loose density when the casing is in a compressed state.

27. An image forming device as claimed in claim 25, wherein the casing includes:

a first casing section having a first sponge member and defining an accommodating chamber accommodating the developer; and a second casing section having a second sponge member, the second casing section moving in contact with the first casing section with opposing surfaces of the first sponge member and the second sponge member sliding against each other.

28. An image forming device comprising:

a processing device including:

a developer cartridge having:

a developer accommodating vessel having:

a casing, the casing having a first casing section and a second casing section, the first and second casing sections defining a developer accommodating chamber that accommodates the developer therein, the first and second casing sections being made of a rigid material;

a developer supply through-hole formed in the casing for filling the casing with developer, the first and second casing sections being movable relative to one another, allowing the developer to be compressed in a direction different from a filling direction in which developer is introduced through the developer supply through-hole; and a developer carrying member for receiving the developer supplied from the casing; and an electrostatic latent image bearing member for forming an electrostatic latent image thereon and for receiving the developer from the developer carrying member; wherein the developer is a powdered developer.

29. An image forming device as claimed in claim 28, wherein the developer is filled in the casing at a density equal to or higher than an apparent loose density when the casing is in a compressed state.

30. An image forming device as claimed in claim 28, wherein the casing includes:

a first casing section having a first sponge member and defining an accommodating chamber accommodating the developer; and a second casing section having a second sponge member, the second casing section moving in contact with the first casing section with opposing surfaces of the first sponge member and the second sponge member sliding against each other.

31. A developer accommodating vessel comprising:

a casing accommodating developer therein;

a developer supply through-hole formed in the casing for filling the casing with developer, the casing capable of being compressed in a direction different from a filling direction in which the developer is introduced through the developer supply through-hole; a developer discharge through-hole formed in the casing for discharging the developer to the outside of the casing, the developer discharge through-hole being provided separately from the developer supply through-hole; and a filter provided on the casing for allowing the passage of air while preventing the passage of developer.

32. A developer filling method comprising:

filling a casing with a predetermined amount of developer, the casing having a first casing section and a second casing section, the first and second casing sections defining a developer accommodating chamber that accommodates the developer therein, the first and second casing sections being made of a rigid material; and compressing the predetermined amount of developer in and the casing in a direction different from a direction in which developer is introduced into the; wherein the developer is a powdered developer.

33. A developer filling method as claimed in claim 32, wherein developer is introduced into the casing in a lengthwise direction of the casing during the filling step.

34. A developer filling method as claimed in claim 32, wherein the casing is compressed in a direction substantially orthogonal to the lengthwise direction of the casing during the compressing step.

35. A developer filling method as claimed in claim 32, further comprising:

fixing the casing after the compressing step.

36. A developer filling method as claimed in claim 32, wherein the developer is filled in the casing at a density equal to or higher than an apparent loose density when the casing is in a compressed state.

37. A developer filling method as claimed in claim 32, wherein the casing includes:

a first casing section having a first sponge member and defining an accommodating chamber accommodating developer; and a second casing section having a second sponge member;

wherein, in the compressing step, the second casing section moves in contact with the first casing section with opposing surfaces of the first sponge member and the second sponge member sliding against each other.

38. A developer filing method as claimed in claim 32, wherein the casing is provided with a filter for allowing the passage of air while preventing the passage of developer in the filling step and in the compressing step.

* * * * *